United States Patent [19]

Gerst

[11] 4,217,484

[45] Aug. 12, 1980

[54] TAXIMETER

[76] Inventor: William J. Gerst, 3265 Dodd La., Eagan, Minn. 55121

[21] Appl. No.: 871,440

[22] Filed: Jan. 25, 1978

Related U.S. Application Data

[63] Continuation of Ser. No. 761,873, Feb. 7, 1977, abandoned.

[51] Int. Cl.[2] ..... G07B 13/10

[52] U.S. Cl. ..... 235/92 DN; 235/92 FP; 235/30 A

[58] Field of Search ..... 235/92 TC, 92 DN, 92 FP, 235/30 R, 30 A; 364/561, 467

[56] References Cited

U.S. PATENT DOCUMENTS

| | | | |
|---|---|---|---|
| 3,111,185 | 11/1963 | Butler | 235/30 A |
| 3,633,818 | 1/1972 | Heath et al. | 235/30 A |
| 3,809,312 | 5/1974 | Warrick et al. | 235/30 A |
| 3,860,806 | 1/1975 | Fichter et al. | 235/30 R |
| 3,970,827 | 7/1976 | Hiroshi Ikuta et al. | 235/92 TC |
| 3,983,378 | 9/1976 | Tammi | 235/30 R |
| 4,001,777 | 1/1977 | Alexander | 364/467 |

*Primary Examiner*—Joseph M. Thesz

*Attorney, Agent, or Firm*—James R. Haller; Steven G. Parmelee

[57] ABSTRACT

A taximeter with logic circuitry that provides passenger detection, distance measuring, clock timing, speed referencing, tamper and fault detectors, manual pushbutton controls, settable constants for distance, time and money, and an emergency power supply. Further logic circuitry is provided to count passengers, calculate and add extras, control calibration externally, condition distance pulses, scan tamper and fault detectors, synchronize and debounce manual pushbutton controls, store and input constants, disable the taximeter, enter an external reset code, and internally compare the reset code. Additional logic circuitry may be provided to control the fare charging clock, perform program arithmetic, perform accumulator functions and control logic operations. Also, additional logic circuitry provides an extras charged display, a fare display, rate of charge display panels, recording counters and control of the taxi toplight. All of the logic circuitry is interconnected to provide a taximeter that accurately computes and displays taxi fares, adds extras charges manually or automatically, displays extras charged on the meter face, detects tampering and circuit faults automatically, displays a tamper number on the meter fare display that indicates the specific tamper or fault, displays meter operation on the taxi toplight, including tampering, disables the taximeter from operation in the event of a tamper or fault, can be reset to normal operation only by an external coded reset device, counts and displays taxi driveshaft rotations on the fare display under the command of an external calibration device, uses two or more selectable charge rates, has rate of charge display panels on the meter face that indicate the rates available to a customer before a meter start and the rate in use when the meter is on, disallows switching from one rate to another on any given trip, synchronizes manual control operations to prevent errors, disables the manual controls at a predetermined minimum speed to prevent mischievous or accidental meter operation, automatically restarts clock charging at minimum speed, disables manual extras the first time the taxi reaches minimum speed, provides a method of accurately calibrating the distance charging sector of the taximeter without any parts or special skills, totals all fare charges on one fare display, performs retroactive charging for any distance traveled by a customer before the meter is started, prevents highflagging by starting itself automatically and accurately whenever a customer is in the taxi and provides positive notice to the taxi owner in the event of any tampering to the taximeter system.

39 Claims, 26 Drawing Figures

LAYOUT ORDER OF TAXI METER SYSTEM SCHEMATICS

LAYOUT ORDER OF TAXI METER SYSTEM SCHEMATICS

TAXIMETER FACE PANEL - 130

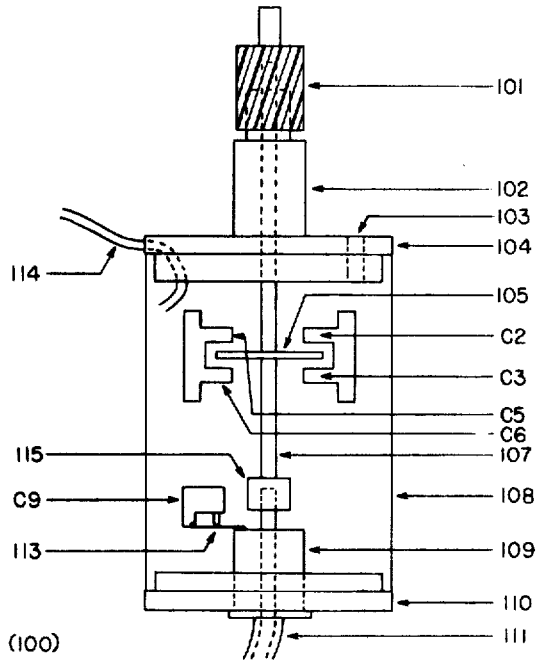
FIGURE 3 (100)
FIG. 3A
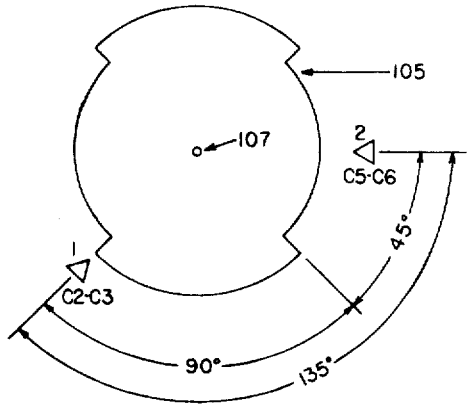
FIG. 3B
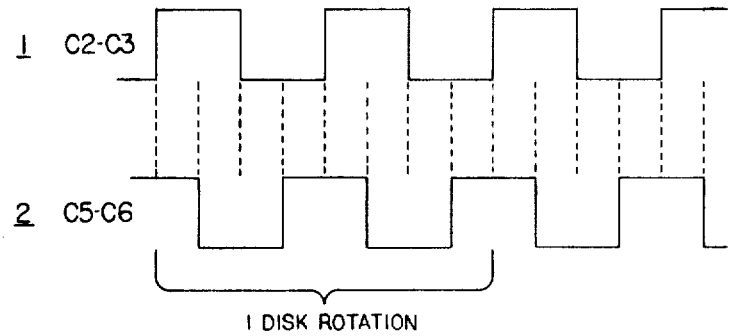

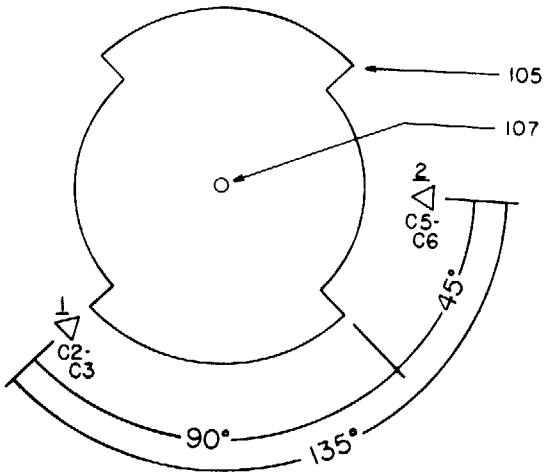
FIGURE 3A
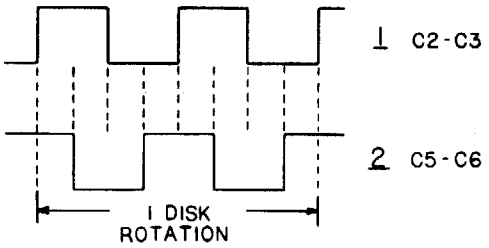
FIGURE 3B
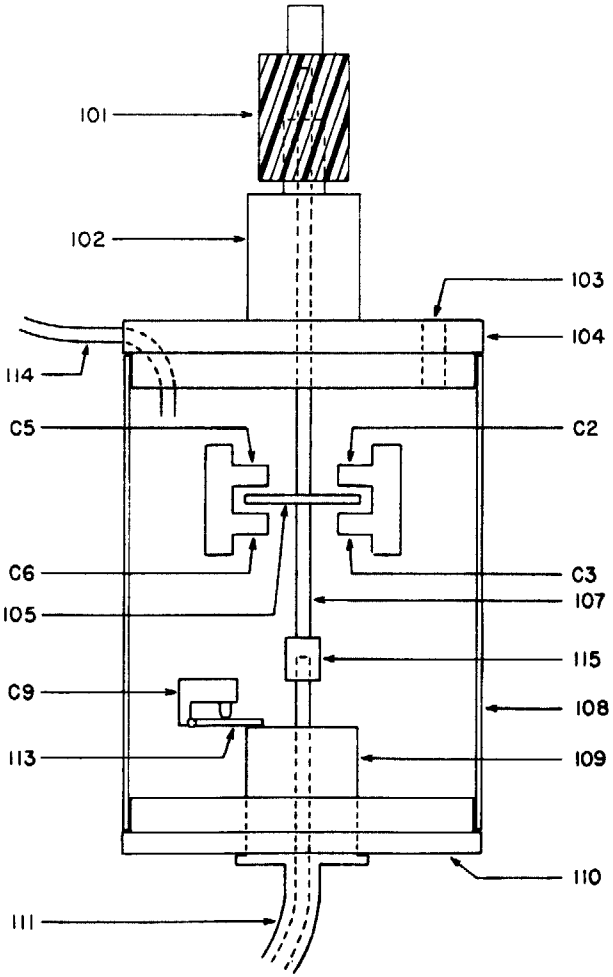
FIGURE 3 (100)

SPEED SENSOR

SWITCH SYNCHRONIZERS AND DEBOUNCERS FIGURE 10

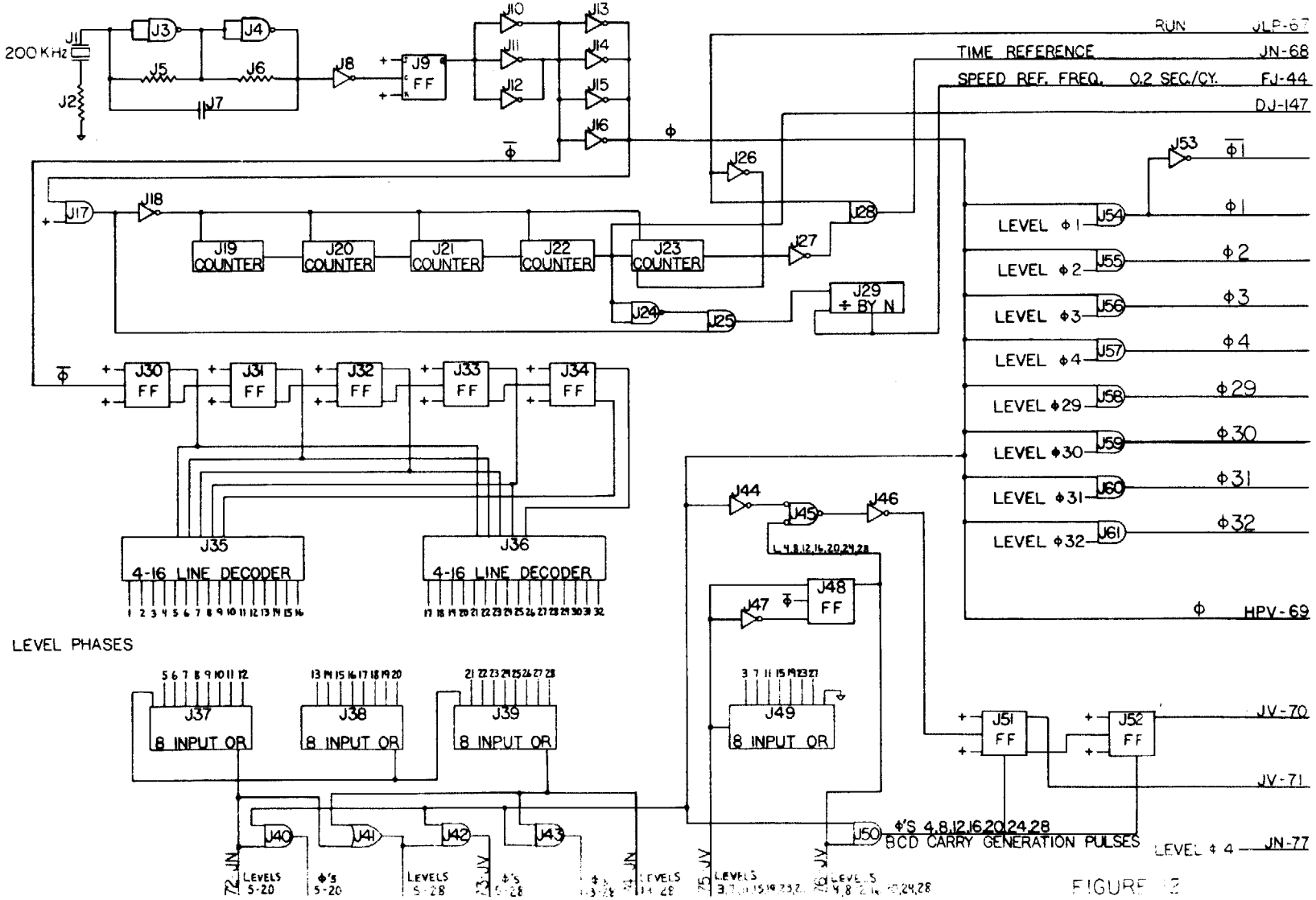
RUN
JN-68
TIME REFERENCE
FJ-44
SPEED REF. FREQ. 0.2 SEC/CY.
DJ-147
LEVEL Φ1
LEVEL Φ2
LEVEL Φ3
LEVEL Φ4
LEVEL Φ29
LEVEL Φ30
LEVEL Φ31
LEVEL Φ32
HPV-69
JV-70
JV-71
JN-77
LEVEL 4 4
FIGURE 12
J52 FF
J51 FF
Φ'S 4,8,12,16,20,24,28
BCD CARRY GENERATION PULSES
J50
J46
J45
J44
J48 FF
J47
J49 8 INPUT OR
J29 ÷ BY N
J28
J27
J26
J25
J24
J23 COUNTER
J22 COUNTER
J21 COUNTER
J20 COUNTER
J19 COUNTER
J18
J17
J13
J14
J15
J16
J10
J11
J12
J9 FF
J4
J3
J6
J5
J7
J1
J2
200 KHz
J34 FF
J33 FF
J32 FF
J31 FF
J30 FF
J36 4-16 LINE DECODER
J35 4-16 LINE DECODER
J39 8 INPUT OR
J38 8 INPUT OR
J37 8 INPUT OR
J43
J42
J41
J40
LEVEL PHASES

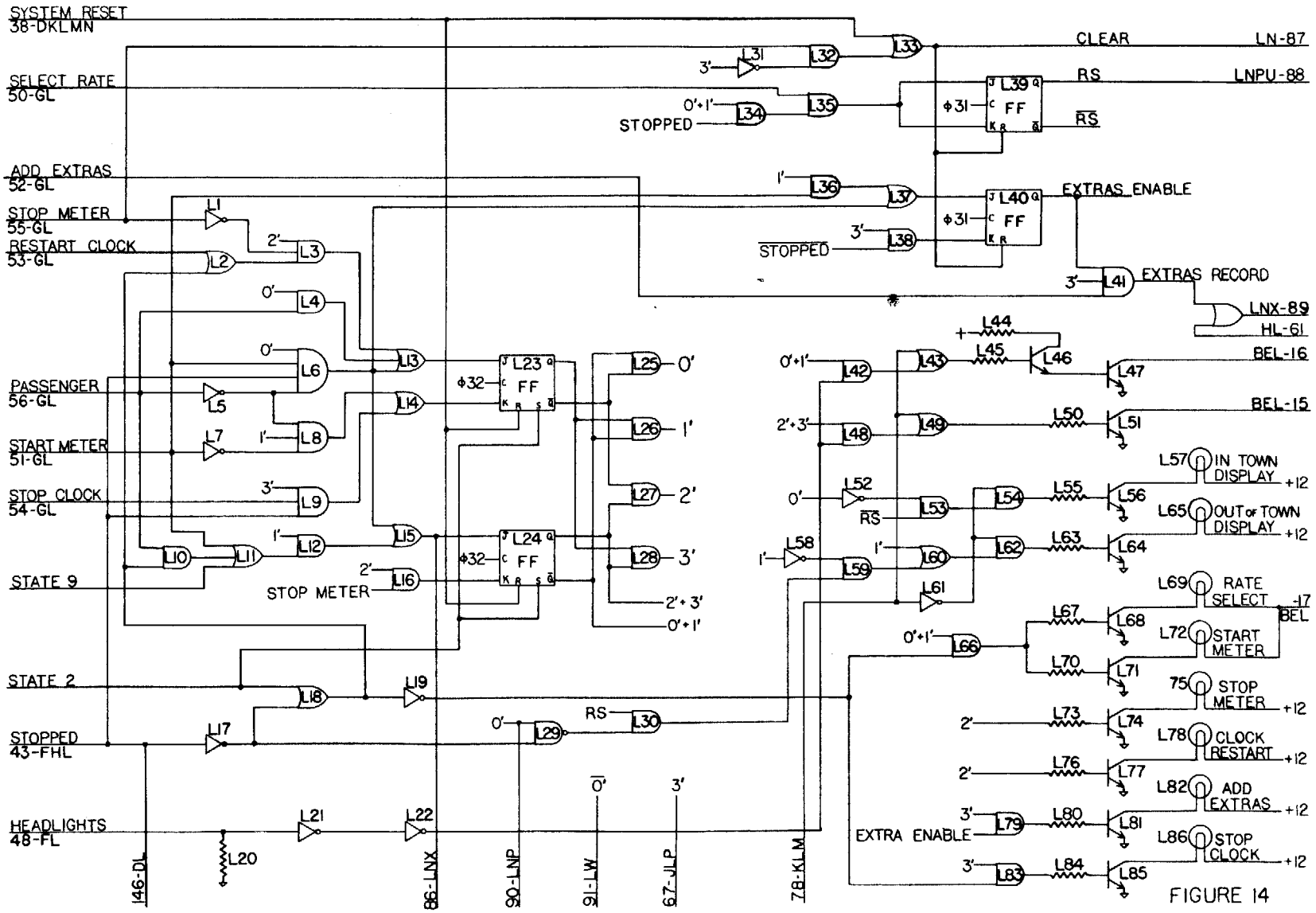
LN-87
LNPU-88
CLEAR
RS
RS
EXTRAS ENABLE
EXTRAS RECORD
LNX-89
HL-61
BEL-16
BEL-15
IN TOWN DISPLAY +12
OUT of TOWN DISPLAY +12
RATE SELECT
START METER
STOP METER +12
CLOCK RESTART +12
ADD EXTRAS +12
STOP CLOCK +12
FIGURE 14
EXTRA ENABLE
STOPPED
STOPPED
STOP METER
SYSTEM RESET 38-DKLMN
SELECT RATE 50-GL
ADD EXTRAS 52-GL
STOP METER 55-GL
RESTART CLOCK 53-GL
PASSENGER 56-GL
START METER 51-GL
STOP CLOCK 54-GL
STATE 9
STATE 2
STOPPED 43-FHL
HEADLIGHTS 48-FL
ZB-KLM
67-JLP
91-LW
90-LNP
86-LNX
146-DL

CLOCK RUNNING SEQUENCER

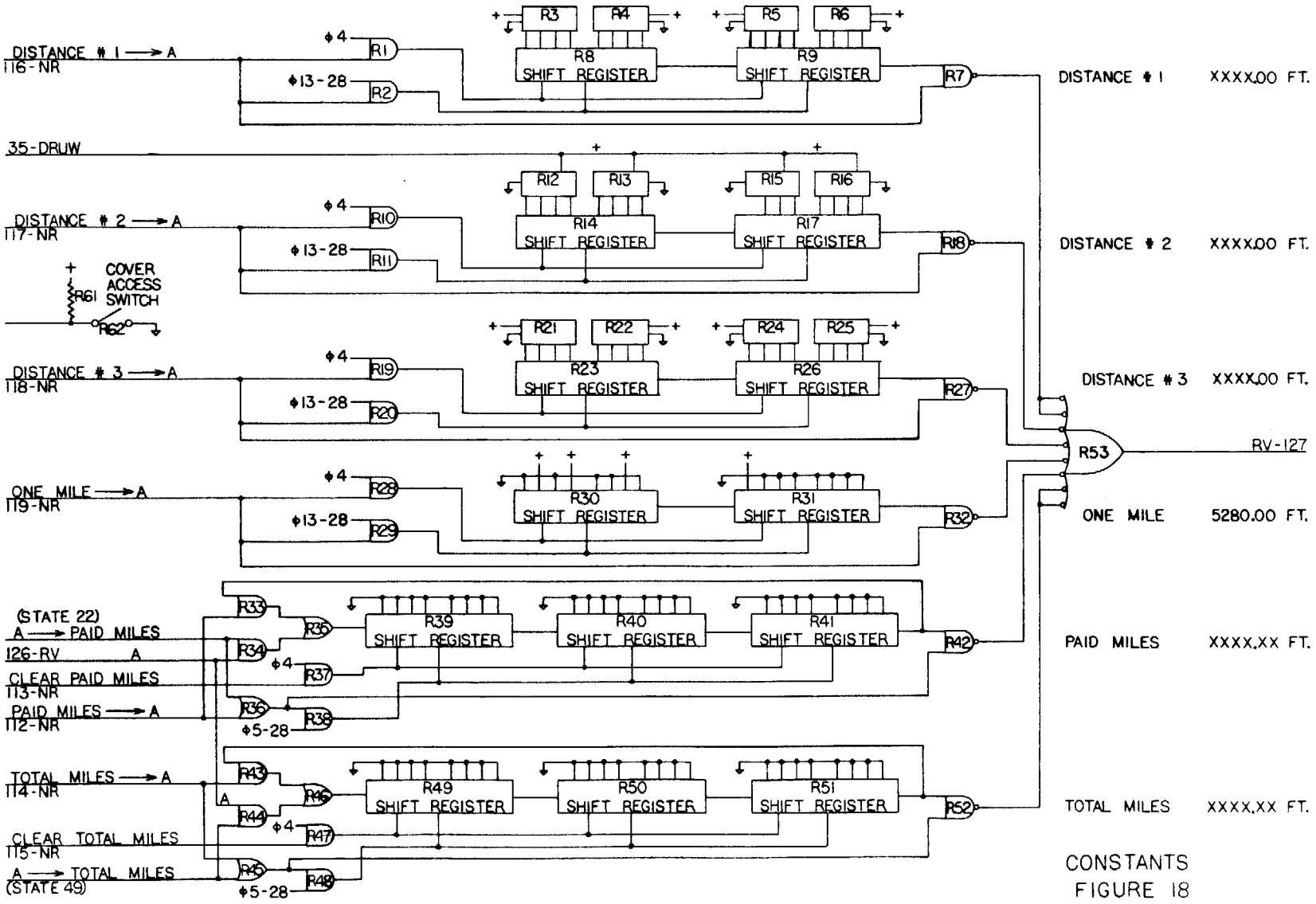
DISTANCE # 1 XXXX.00 FT.
DISTANCE # 2 XXXX.00 FT.
DISTANCE # 3 XXXX.00 FT.
RV-127
ONE MILE 5280.00 FT.
PAID MILES XXXX.XX FT.
TOTAL MILES XXXX.XX FT.
CONSTANTS FIGURE 18
R53
R7
R18
R27
R32
R42
R52
R9 SHIFT REGISTER
R17 SHIFT REGISTER
R26 SHIFT REGISTER
R31 SHIFT REGISTER
R41 SHIFT REGISTER
R51 SHIFT REGISTER
R8 SHIFT REGISTER
R14 SHIFT REGISTER
R23 SHIFT REGISTER
R30 SHIFT REGISTER
R40 SHIFT REGISTER
R50 SHIFT REGISTER
R39 SHIFT REGISTER
R49 SHIFT REGISTER
DISTANCE # 1 → A
116-NR
35-DRUW
DISTANCE # 2 → A
117-NR
COVER ACCESS SWITCH
R61
R62
DISTANCE # 3 → A
118-NR
ONE MILE → A
119-NR
(STATE 22) A → PAID MILES
126-RV
CLEAR PAID MILES
113-NR
PAID MILES → A
112-NR
TOTAL MILES → A
114-NR
CLEAR TOTAL MILES
115-NR
A → TOTAL MILES
(STATE 49)
φ4
φ13-28
φ5-28

STATE TRANSITION TABLE FOR THE ARITHMETIC SECTION

TAXIMETER

CROSS REFERENCES TO COPENDING APPLICATIONS

This is a Continuation of Patent Application Ser. No. 761,873, filed Feb. 7, 1977 for TAXIMETER, which patent application has now been abandoned.

BACKGROUND OF THE INVENTION

1. Field of the Invention

This invention relates generally to a taximeter, and more particularly, a taximeter to prevent "highflagging" and tampering.

2. Description of the Prior Art

In the field of taxi meters, it has been a general practice to employ mechanical and recently, electronic taximeters. The taximeters most commonly employed in taxis in the United States presently are turned on and off manually by the taxi drivers. These taximeters employ an odometer to measure the distance and a clock to measure the time of a trip. Taxi fares ordinarily are based on a given rate per mile or fraction thereof, or on a given rate per minute or fraction thereof, depending on which method of computation produces the higher fare. Since taximeters are turned on and off by the drivers and since the amount of fares which must be reported during each driver shift is based upon the accumulated record of the fare total from a taximeter, it has in the past been relatively easy for a driver to report less accumulated fares than were actually collected. For example, a driver may simply neglect to turn the taximeter on, denoted as "highflagging", and may instead charge a customer an agreed amount for a certain trip. This amount would not appear on the meter and would not be recorded thus not having to be accounted for at the end of the driver's duty shift.

Various attempts have been made to provide taximeters which are not subject to cheating by a driver. However, from experience, taxi drivers are in general a canny group and past taximeters are easily overcome or disabled. Many previously advertised and claimed untamperable taximeters are in fact tamperable. U.S. Pat. No. 3,809,312 (Warrick et al.) shows a mechanical meter having an anti-tampering device.

It has been estimated that, according to one 1973 magazine article, in New York City alone approximately $53.5 million of the total fares collected from taxi customers each year are not acounted for by taxi drivers. Even the most conservative theft estimates declare that theft runs a minimum of $2,000 each year for each taxi. Cheating of this type, which is commonly acknowledged in the taxi business, is a serious problem, and although various methods have been used to reduce the problem, none of the methods have been successful.

A patent issued to Bruce Sanders, U.S. Pat. No. 3,512,706, discloses an electronic taximeter with digital readout. Patents issued to Harwood, U.S. Pat. No. 3,818,186; Fichter et al, U.S. Pat. No. 3,860,806, and Berg, U.S. Pat. No. 3,703,985 disclose electronic taximeters. A patent issued to Weisbert, U.S. Pat. No. 3,553,442, discloses circuitry to turn on a taximeter by sensing the presence of a passenger by a seat sensor and after twenty-five seconds have elapsed, triggering a circuit to activate a meter which is not previously running. A patent issued to Paz, U.S. Pat. No. 3,674,986 discloses a counter system to count trips whenever the meter is off and there is a passenger, whenever the taxi reaches the minimum speed. None of these patents disclose a taximeter to prevent highflagging and which is untamperable.

This invention overcomes the disadvantages of the prior art by providing a taximeter which among other new and novel features prevents highflagging and tampering.

SUMMARY OF THE INVENTION

The present invention obviates the foregoing disadvantages of the prior art by providing an automatic taximeter system which can be easily and relatively inexpensively installed in a taxi and which prevents "highflagging" by performing accurate meter starting, and which is tamperproof. The taximeter system effectively provides for either normal meter operation every time the taxi has a customer or sure notice to the taxi company in the event of any tampering by the driver. By "taximeter system" or "taximeter" as is used herein, reference is made not only to the taximeter control box which includes the meter face panel, fare calculating circuitry and control logic circuitry, but also external devices and electromechanical connections which include power lines, occupancy and movement sensing devices and electrical logic control connections including the tamper detection system.

According to one embodiment of the present invention, there is provided both automatic and manual electrical input circuits, the latter operable by the taxi driver. It should be understood that the manual driver inputs are operable only under the logic control program of the taximeter. An occupancy sensor, which may be a seat sensor of the type utilized in many automobiles, includes electronic circuitry which automatically generates a predetermined electrical logic signal that indicates the presence of a passenger on the taxi's seats.

Another automatic electronic circuit senses movement of the taxi, and supplies electronic logic signals characteristic of distance traveled. The taximeter includes timing circuitry and fare accumulator circuitry which in turn displays a digital fare on the display board of the taximeter face panel. The fare accumulator circuitry senses signals from the accupancy sensor, movement sensor and the internal clock. By electronic reference to one or more constants providing distance and time charging variables, the accumulator calculates and causes to be displayed the maximum fare including extras charges. It is understood that when the taxi stops in traffic, the time fare rate is greater, whereas when the taxi is in rapid motion, the distance fare rate is greater. In the breakeven area between time and distance, both calculations occur simultaneously and circuitry means is provided to add to the fare depending on whichever reaches maturity first.

The taximeter of the invention is externally powered, for example, by the battery of the taxi, but desirably has its own internal power source, such as a rechargeable nicad battery. This internal battery, which is inaccessible to the driver, maintains the taximeter system in active operation even when the external power is disconnected. The loss of external power is detected as a tamper, however, and if that occurs, the normal metering of taxi fares will be disabled according to the tamper program. The taximeter includes a physical electronic component box, one side of which is the taximeter face panel, appropriately designed to prevent it from being opened without detection. The occupancy sensor, the movement sensor and the external power supply constitute the vital external portions of the meter which are subject to tamper disconnect modes. The meter includes sensing circuitry for sensing the electronic tamper characteristics of the external meter circuitry to operate with comparison circuitry to compare the sensed electronic characteristics with previously determined electrical characteristics which correspond to untampered circuits. The comparison circuitry further includes means producing an electronic tamper signal when the sensed logic characteristics differ by a predetermined amount from the previously determined logic characteristics.

A significant aspect and feature of the present invention is an automatic meter starting feature that prevents "highflagging." Control circuitry automatically starts the taximeter whenever there is a passenger in the taxi and the taxi reaches either a predetermined minimum speed or travels a predetermined minimum distance. Both of these conditions accurately conclude that the passenger is in fact a customer and the resulting meter start, which is also accurate, effectively stops attempted highflagging by the taxi driver. Hence, the invention provides a taximeter having occupany-sensing means to detect a passenger, speed-sensing means to measure speed of a taxi and including clock means and distance-sensing means measuring distances traveled by the taxi, and fair calculating means responsive to the distance-sensing and clock means for computing a fare based upon time elapsed or distance traveled or both. The meter includes logic means responsive to the occupancy-sensing means, and to at least one of the speed-sensing means and distance-sensing means for starting the meter when 1. a passenger is detected by the occupancy-sensing means, and 2. the at least one sensing means concurrently senses that the taxi has reached a predetermined speed or has traveled a predetermined distance, respectively.

Another significant feature of the present invention is a tamper system that does not permit tampering of any portion of the taximeter, either electrical or mechanical. There is thus provided a taximeter including a meter housing, external occupancy-sensing means to detect a passenger, external distance-sensing means to sense distances traveled, external power means to provide electrical power to the meter, and tamper detection means for detecting tampering with the individual distance-sensing, occupancy-sensing, power means, and housing for producing signals indicating such tampering. The tamper detection means comprises a tamper scanner to continually scan tamper and fault detector circuits. When the tamper scanner finds a tamper it transmits a coded tamper number to other circuitry that will cause the tamper number to be displayed on the fare display of the taximeter face panel. The tamper number indicates specifically which tamper has occurred. Further control circuitry then disables the taximeter from further operation. Normal operation is restored by using a reset module that applies a reset code to a reset code comparison interface. The reset code interface compares the code it receives with a code previously set in its circuitry. If the code comparison results in an exact match, the reset code interface will signal the control circuitry to restore normal operation.

Yet another significant feature of the invention is the provision in a taximeter of means for readily changing the constants employed for fare charges, etc. Constants furnishing means are provided within the meter housing and hence can be controlled only by the meter owner or his agent. The constants furnishing means includes manually settable control means within the housing for varying the constants furnishing means to permit changes in the fare rate without requiring the replacement of gears, memory components, etc.

A further significant aspect and feature of the present invention is an automatic calibration feature which permits easy, fast and accurate calibration of the taximeter by presetting constants through the use of binary coded decimal switches in the taximeter control box. To calibrate the taximeter, it is only necessary to plug in a taximeter calibration control box and place the taximeter in the calibrate mode. When the taxi is driven in the calibrate mode, control circuitry in the taximeter system causes the driveshaft rotations to be counted and displayed on the fare display section of the taximeter face panel. Driving over a measured course in the calibrate mode provides a count of the driveshaft rotations which occur in the measured distance. Dividing the distance traveled on the course by the number of driveshaft rotations results in the number needed on the binary coded decimal switches. The number is then placed on the switches in the control box and the calibration is complete. This results in a highly accurate calibration of the distance measuring functions.

An object of the present invention is to provide circuitry to accurately start the taximeter automatically whenever the taxi driver has a customer and does not start the meter. This is done either when a passenger is in the taxi and the taxi reaches a predetermined minimum speed, for instance, in a range of five to ten miles per hours, or if the minimum speed is not reached, then when a passenger is in the taxi and a predetermined minimum distance has been traveled.

Another object of the invention is to provide tamper and fault system circuitry for detecting tampers or faults. The tamper and fault system circuitry uses specifically designed detector circuits for each portion of the taximeter in question, each of which outputs the occurrence of a tamper to a tamper scanner. The tamper scanner scans each of these detectors and, upon finding a tamper, outputs a coded tamper number for that specific tamper and a fault signal to central control circuits which will display the tamper number on the meter face, indicate the presence of a tamper on the taxi toplight and disable further taximeter operation by supressing fare display. Among the tampers and faults which may be detected are power tampers, seat switch tampers, speed sensor tampers, meter control box tampers, constants access tampers, reset-calibrate connector access tampers, accumulator faults and clock running sequencer faults.

A further object of the invention is to provide a method of calibrating the distance charging portion of the meter which is highly accurate, easy to perform, and does not require the replacement of such parts as gears or electronic memory components.

An additional object of the invention is to provide circuitry to reset the disabled taximeter system to normal operation by the use of an external device held only by the owner of the taximeter, such as the owner of the taxi company. The reset box, at the same time, also has the calibration circuitry in it, for convenience, to allow the taxi owner to reset a tamper or calibrate the meter, whichever is desired.

Another additional object of the invention is to provide fully synchronized manual pushbutton controls that simplify taximeter operation and prevent undesirable operational errors.

Another object of this invention is to provide rate-of-charge display panels which indicate what charge rate the meter is currently using for computing the fare and listing the charging particulars used in computing the rate rate. Two rates shown on the meter face are for "in-town charges" and "out-of-town charges", the particulars of charging for computing the fare being different for each charge rate.

Another object of the invention is to provide a method for using a second rate of charge for out-of-town taxi rides. Two principle objects of this provision are the prevention of switching back and forth from one rate to another rate once the meter is started and the further guarantee that the meter shall be used on all trips.

A further object of the invention is to provide for changing of charging rates, which is simple and requires no parts, mechanical or electrical, or special skills which can be performed only by authorized personnel. This is done by providing a set of binary coded decimal switches on which the constants used are entered in decimal form and output in binary form to the electronic logic circuitry for accumulation. Rate changes thus require only knowledge of what numbers are needed on the switches for the applicable rates to be charged, in- and out-of-town. All of this is performed only by first tampering the meter to gain access to the switches. Once tampering occurs, changing the switches is worthless to the tamperer because he doesn't have a method to reset the tamper disabled meter to normal fare charging operation.

Still another object of the invention is to provide a method for disabling the pushbutton manual control switches automatically so that the switches cannot intentionally or accidently be operated by anyone while the taxi is moving. A minimum speed pulse which occurs when the taxi reaches, for example and illustration only, ten miles per hour, is used as a signal that disables all of the manual pushbutton controls. The switches will become reenabled again when the taxi slows to below the minimum speed.

An additional object of the invention is to provide for charging the customer for any distance he travels in the taxi before the taximeter is started. This charge will be made retroactively when the meter is started. With a passenger in the taxi, circuitry is enabled to calculate any distance traveled by the taxi. Then, when a meter start occurs, any distance already traveled is deducted from the initial distance calculation, thereby charging the customer for the distance traveled before the meter start occurred. The meter start may be either automatic or manual.

Another object of the invention is to provide separate settable time-charging constants which can be set in proportion to whatever distance-charging measurement is in use. In most cases, it is desirable to be able to set a specific time for use with each distance measurement that is used. This often occurs because the first distance measured is different from subsequent distances measured, or occurs when different rates are used.

Yet another object of the invention is to provide a taximeter in which the control logic circuitry is continuously running, regardless of whether the taxi engine is running or not. The system is designed to scan for faults or tampers continuously, to signal any logic input and to perform any function of the operational program. The system constantly maintains this total operation independent of any manual input. An example is that an automatic start of the taximeter occurs whenever there is a passenger, and minimum speed is reached or minimum distance is traveled.

A further object of the invention is to provide for automatically restarting the clock and disabling the manual extras switch. Minimum speed pulses start the clock if the taximeter fare charging is enabled and the clock is stopped. Manual extras are disabled the first time the taxi reaches the minimum speed after a meter start, although the automatic extras continues to operate.

Still another object of the invention is the provision of an extras display on the taximeter face panel which includes an extras display digit and a backlighted panel labeled "extra" that informs the customer how many extras are being charged on the fare display for the trip currently in progress.

An additional object of the invention is to provide for a fare display on the taximeter face panel that includes the total of every charge for which the customer has been assessed, including extras.

Another object of the invention is to provide for counting the number of passengers in the taxi through the use of specifically placed seat sensors in the passenger seating areas which feed a logic circuit that computes the total number of passengers in the taxi. These same seat sensors also provide the logic input to the control circuitry which signals the presence of a passenger in the taxi. There is thus provided a system capable of charging extras automatically whenever more than one passenger is in the taxi. Circuitry provides for this system to either operate alone or in conjunction with the manual extras switch input. This provides positive extras charging whenever the taxi driver does not make these charges as he is supposed to, either intentionally or through forgetfulness.

Yet another object of this invention is to provide for obtaining speed sensor pulses with an electromechanical device specifically intended for attachment between the automobile transmission and the speedometer cable and providing tamper detection circuitry to detect its removal or any tampering of the device. The device attaches directly to the transmission, is driven by the transmission and provides a distance pulse train to the taximeter. The device does not require specially purchased gears or electrical components for its operation and is intended for use on any taxi, since its distance pulse train is accurately calibrated in the taximeter control box.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference numerals designate like parts throughout the figures thereof and where:

FIG. 3 illustrates a speed sensor which fits into the transmission housing of the taxi;

FIG. 3*a* illustrates the sensor disc in the speed sensor;

FIG. 3*b* illustrates the square wave timing diagram generated by the speed sensor;

FIG. 12, sheet J, illustrates the 32 phase clock generator, time reference and speed reference;

FIG. 14, sheet L, illustrates the clock start and stop sequencer circuitry, and light driving circuitry;

FIGS. 18, 19 and 20, sheets R, T, and U respectively, illustrate the constants and storage circuitry;

DESCRIPTION OF PREFERRED EMBODIMENTS

Figure 1:
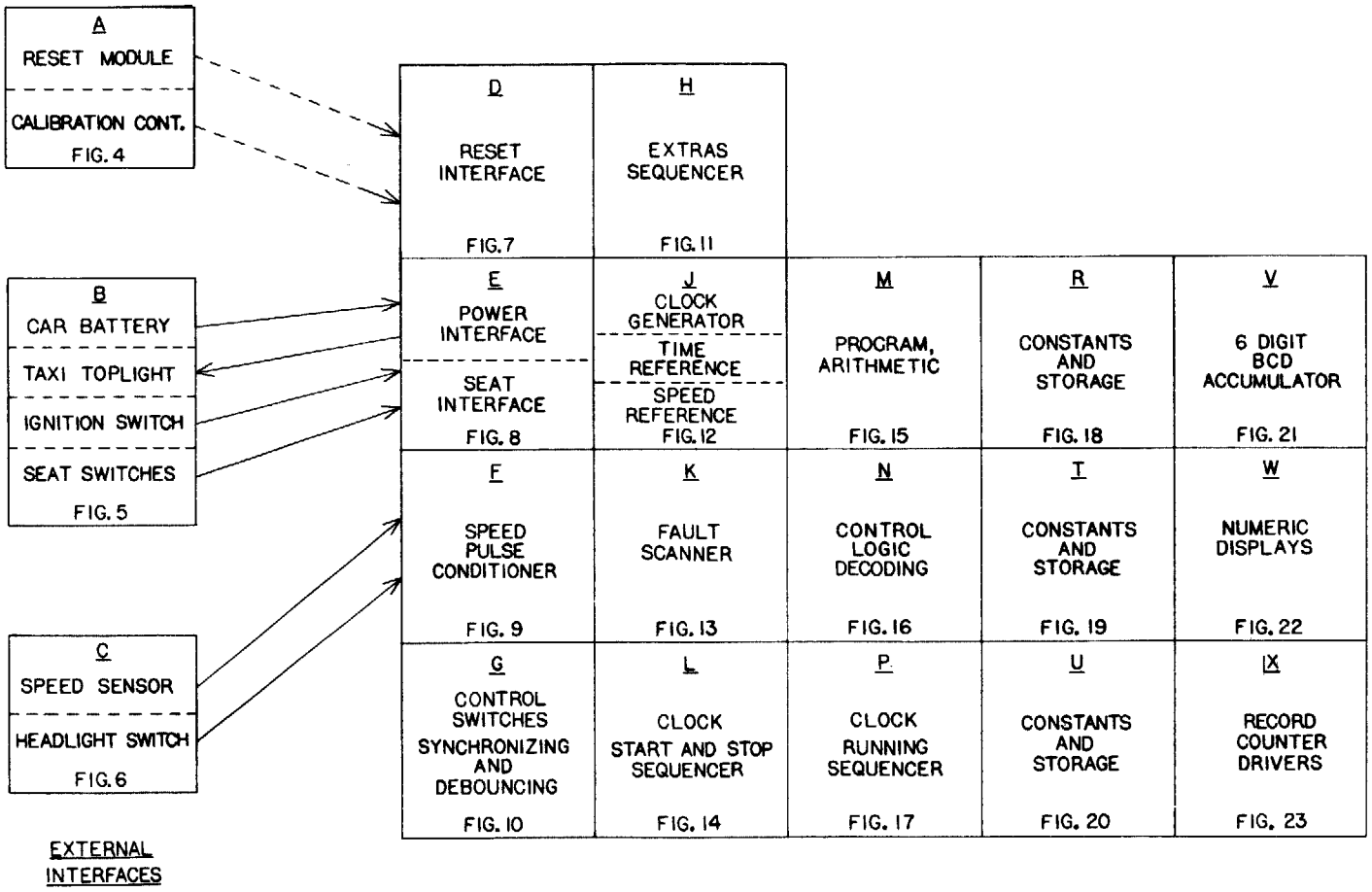
FIG. 1 illustrates the order of the taximeter schematics and drawings of the invention.

FIG. 1 shows the layout order of the taximeter schematics for purposes of description of the invention. Each block is labeled with a letter except I, O and Q and refers to one sheet of the schematics, respectively. The titles below each letter indicate that portion of the system to be found on that sheet and figure. Blocks D, E, F, G, H, J, K, L, M, N, P, R, T, U, V, W and X, FIGS. 7-23 respectively, are placed together as a group because they comprise the main control box of the system.

Figure 4:
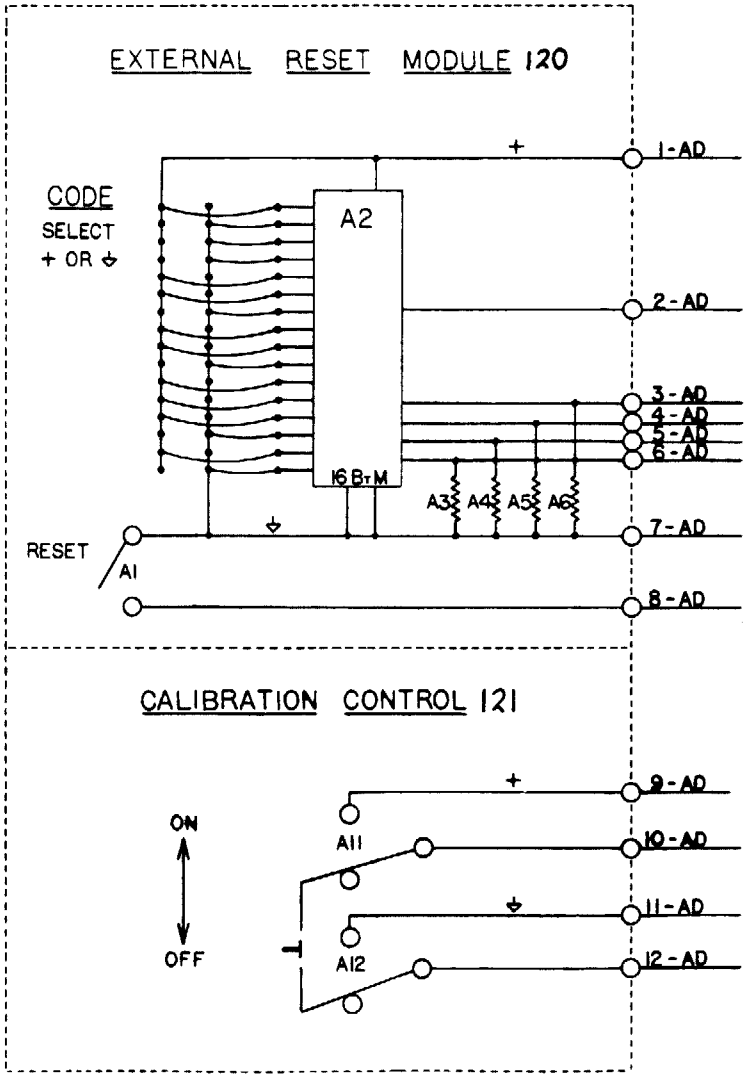
FIG. 4, sheet A, illustrates the external reset module and external calibration control circuitry.

Block A, FIG. 4, contains the external reset module A1-A6, and the calibration control A11 and A12 that make plug-in contact with the meter box via a mating connector only when the use of these two devices is required. Block B, FIG. 5, contains the car battery B1, taxi toplights B11 and B12, external ignition switch B21 and a typical seat switch arrangement circuitry B31-B33. Block C, FIG. 6, contains the speed sensor C1-C9 and vehicle lights switch C11 and C12. Blocks B and C are external interfaces that maintain constant connections to the meter box.

Each component is designated by its respective alphabetical sheet letter and its respective component number on that sheet. Each electrical connection between figures and sheet of drawings is designated by a line number and the alphabetical letters of the pages to which it attaches.

Blocks A, B and C are separated from the other sheets because they are external interfaces that connect to the taximeter control box. The arrow lines connecting A, B and C to the rest of the system are important. The solid lines from blocks B and C indicate that the interfaces are to constantly maintain their connection with the meter box whereas the broken lines of block A refer to devices that only connect to the taximeter face panel infrequently via mating connectors such as plug-in connectors.

Figure 2:
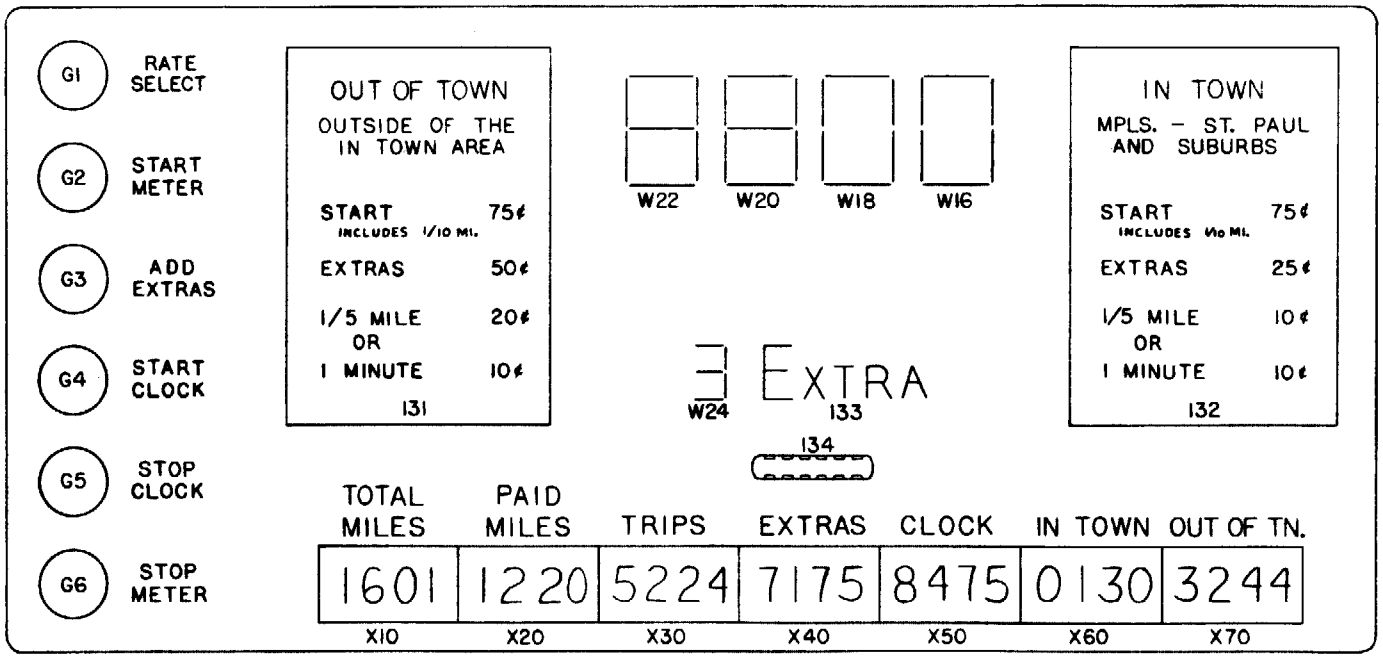
FIG. 2 illustrates the taximeter face panel.

FIG. 2 illustrates the face of the meter. On it are manual pushbutton controls G1 thru G6 through which the driver is able to make control inputs to the meter system. Lighted rate of charge sign panels labeled as "Out-of-Town", 131, and "In-Town", 132, having back lights L65 and L57 respectively, are used to indicate to the driver and customers exactly how taxi trip charges will be made if the passenger hires the taxi. Digital fare displays W16, W18, W20 and W22 are used to indicate the fare as it is incurred by the customer. An extras display digit W24 and a sign panel labeled "Extra", 133, having a back light W28, are used to indicate the number of extras that have been added into the total fare on the digital fare display. A set of electromagnetic recording counters X10, X20, X30, X40, X50, X60 and X70 continuously records all pertinent data with regard to charged fares and overall taxi operations. Also shown is a connector 134 into which the external reset/calibrate device 120-121 of FIG. 4 is plugged when either of those operations are needed.

SPEED SENSOR

FIG. 3 illustrates the electromechanical speed sensor 100 which mates with the taxi transmission. Gear 101 mates with the driveshaft inside the taxi transmission. The driveshaft turns this gear 101 and the sensor shaft 107 which is anchored in it. Plug 102 is a duplicate of the plug on the speedometer cable which was formerly inserted into the transmission. It is now a part of sensor base 104. The purpose of the plug 102 is to align the gear 101 properly with the driveshaft inside the transmission. Hole 103 aligns with the threaded hole on the transmission which formerly was used to hold down the clamp which held the speedometer cable head in place. It is now used to run a bolt from the interior of the sensor device through hole 103 and into the threaded hole in the transmission to hold the base 104 of the sensor 100 securely in place on the transmission. The sensor base 104 is machined to match the surface of the transmission and is used as the foundation of the speed sensor unit 100. Sensor disc 105 of FIG. 3B is secured to the sensor shaft 107 and turns with it. On it are two ninety degree cutouts which will be rotating between the phototransistor light senders C2-C5 and receivers C3-C6. Rotational stability is the main consideration; where one cutout requires a counterbalance, two or more cutouts are stable when symmetrically balanced. The phototransistor pairs have a light sending unit on one side C2 and C5 and a light receiving unit C3 and C6 on the other side of their extensions. The sensor disc 105 rotates between the arms and either allows or disallows the light from C2 or C5 to reach C3 or C6. Whenever light reaches C3 or C6 they emit a pulse to the taximeter system. Placing the phototransistors at 135°, as shown in FIG. 3A, results in squarewave patterns that are sequenced in perfect opposition to each other. Evenly spaced squarewave patterns are the result of the 90° symmetric cutouts in the disc. Phototransistor squarewave patterns produced by the mechanical layout of the sensor components are shown in FIG. 3B. The speed pulse conditioner of FIG. 9 requires two pulses from each phototransistor before it outputs a speed pulse. Each speed pulse thus represents one full rotation of the speed sensor disc 105. The phototransistors pass light whenever a cutout, open disc area, is between the light senders C2 or C5 and the light detector C3 or C6. The time interval during which this send-receive operation occurs is influenced by three factors; (1) the number of cutouts and, (2) the rotational speed of the disc and, (3) the size of the disc. The disc size is limited because the device package must be kept small; the rotational speed is fixed by the necessity of feeding the vehicle speedometer cable a specific rotational speed. Thus, by selecting the minimum number of cutouts, two in this instance, one is able to maintain stability and increase accuracy by using the longest available time interval. If one phototransistor unit is used, a problem is created. When the edge of the disc is in a position such that it just touches the light path between the light sender and receiver, a fibrillating action can occur. This causes the receiver to alternately receive or not receive light. Unable to differentiate between fibrillation and actual disc rotation, the receiver keeps sending speed pulses, even though the disc is not rotating. By using two phototransistors set at angles in which only one of the two can be on a disc edge at a specific time and then requiring alternating pulses from each phototransistor until before issuing a speed pulse, one is able to eliminate fibrillation phenomenon errors from occuring. This is why the speed sensor system is equipped with two phototransistors. Sensor shaft 107 is rotated by the vehicle transmission. On it are the sensor disc 105 and a mating coupler 115 for the speedometer cable 111. Sensor case 108 is essentially a tube which is used to house and protect the inards of the sensor; nothing is attached to it. It is held in place by two bolts which run through from the lid to the base of the device. Speedometer cable plug 109 is the plug which originally went into the transmission; it now inserts into the sensor lid 110. The speedometer cable plug 109 inserts through the sensor case cover 110 and positions speedometer cable 111 to mate with coupler 115 and to depress the tamper switch 112. Sensor lid 110 is the top cover of the device. It has a pilot hole for the speedometer plug 109 and a clamp to hold it in place which is not shown. It also has two holes, not shown, in it to allow for the passing of two bolts through to the base 114 of the sensor. These bolts, not shown, travel into the sensor case and hold the device together. Speedometer cable 111 is the original speedometer cable which went to the speedometer in the taxi. Tamper switch C9 is the switch which interfaces to the tamper detection circuitry F30–F44. Anything that results in the switch C9 closing will cause the signaling of a tamper. In the normal untampered condition the switch is normally open; when C9 is depressed, the switch is open. Moving switch arm extender 113 thus causes movement of the switch C9. When there is no tamper, the arm holds C9 down. A tamper allows the arm to go free and allows C9 to come up. The arm is placed such that any movement of 108, 110 or 111 to gain access will free the arm 113. Wiring 114 is armored wiring cable. It contains all of the connections from the sensor device 110 to the meter. It may be of a pluggable type into the sensor; but, it must be absolutely waterproof. It should also have some sort of connector that cannot be accidentally dislodged. Coupler 115 is a solid part of the sensor shaft 107 and it is the connection point between the shaft 107 and the speedometer cable 111 that will be inserted into it. Normally the end of the speedometer cable 111 is square and this coupling 115 uses a square hole into which the cable 111 slides. On the other end of the sensor shaft a similar connection is made between the sensor shaft and the gear that mates with the transmission driveshaft.

RESET OPERATION

FIG. 4 illustrates the external reset module circuitry. Whenever the meter is disabled because of a fault or tamper, it becomes necessary to perform a code match reset to restore normal meter operations. To perform a reset, an external code device 120 is plugged into a mating connector 134 on the meter. This connects lines 1-AD through 8-AD on the reset module 120 of FIG. 4 to lines 1-AD through 8-AD of the reset interface of FIG. 7. Then reset switch A1 is closed. This causes the reset code on the 16 Bit Multiplexer A2 to be read bit by bit into the interface, for the purpose of identifying the module as the proper module for the meter. The reset interface of FIG. 7 then compares the reset code received from A2 to its own code which was placed into 16 Bit Multiplexer D3. At the end of a full comparison of the codes from A2 and D3, the interface circuitry of FIG. 7 will output one of two signals. If the codes were not identical, indicating negative identification, a code mismatch signal will be output from D8 when switch A1 becomes open again. In the case of an identical match of the codes, indicating proper identification a reset signal will be sent from device D10. This signal will cause the restoration of the taximeter to normal operation. It should also be noted that, although the correct A2 code would cause a system reset signal from D10, the restoration of normal operation may not occur. If a tamper still exists, the tamper scanning devices K1 or K2 of FIG. 13 would detect it immediately and return the meter to the tampered state. Thus, resetting requires also that all of the external connections are properly maintained. A normal code match reset thus requires two conditions to return to normal operation of the meter. The first condition is that the external connections must be intact and the second condition is that the correct code must be properly applied. The codes on devices A2 and D3 are selectable by connecting each of the code lines to either high or low. The external reset module 120 is held by the taxi company thus depriving the taxi driver of the device and the code necessary to restore the meter to normal operation. Thus, if a driver were to tamper with the meter in an attempt to disable its automatic operations, the meter would lock up in the tampered state. Without the resetting module 120, the driver would be forced to return to his company in the tampered state which would be detected immediately by the management. Further, the code of device D3 cannot be read externally because no output is made until the full 16 bit complement is compared. Additionally, further complication exists because there are n lines to be connected. To input a code, it is necessary to first decipher what each line of the connector is doing. Additional complexity can be obtained by either expanding the number of lines used on the connector or adding additional multiplexers to A2 and D3 to lengthen the binary code being used. Multiple codes can also be used so as to require decyphering one code first to reach another code. Increasing the number of connector contacts would also allow the setting of "traps" at different connector terminals to detect probing of the connector. FIG. 4 also illustrates the calibration control circuitry showing external switches A11 and A12 to activate the internal circuitry which counts and displays the number of rotations of the driveshaft. Thus, the module includes not only identifying means, as described, but also meter function means controlling the reset and rotationcounting functions of the meter.

VEHICLE BATTERY

Figure 5:
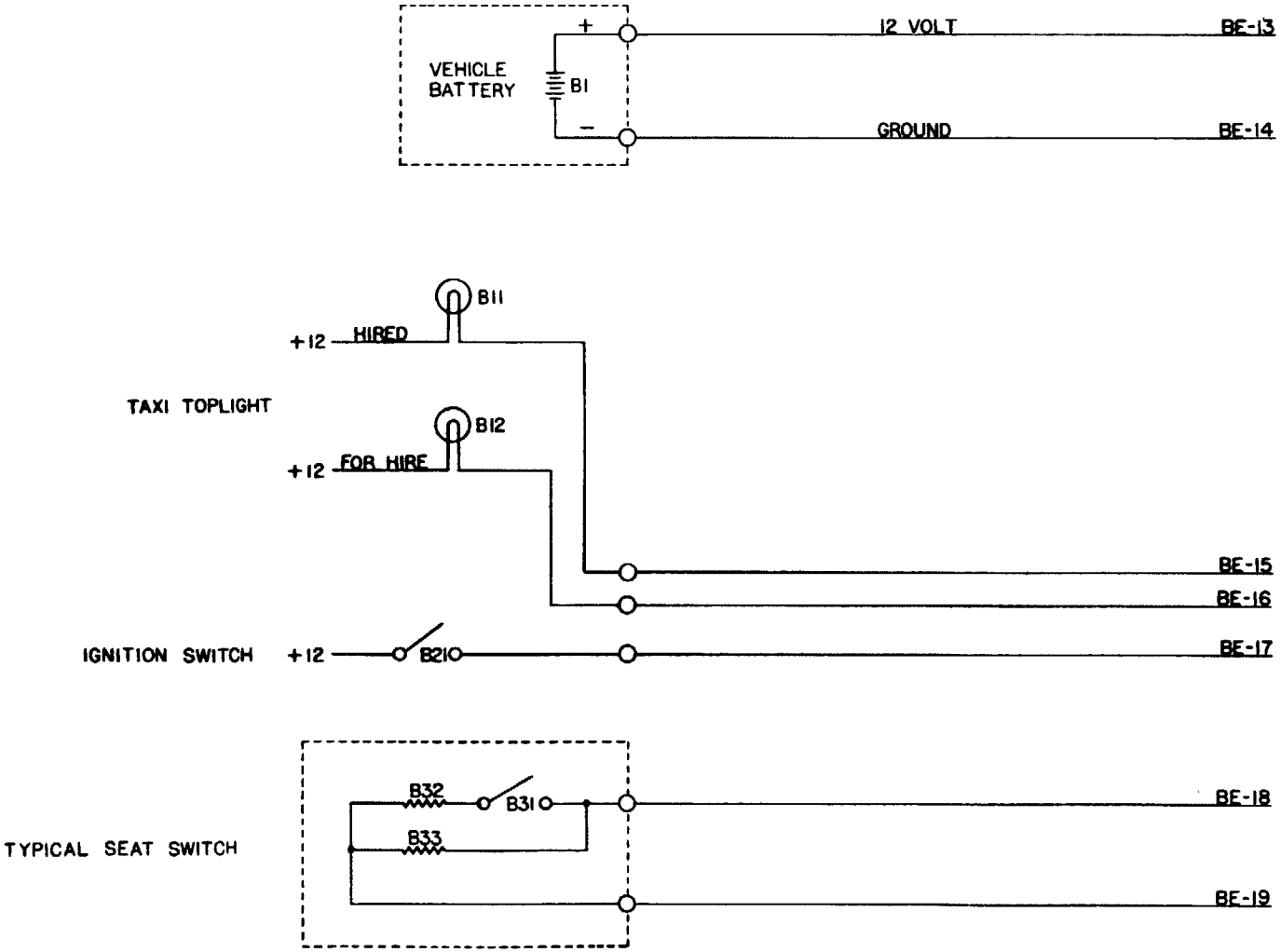
FIG. 5, sheet B, illustrates the taxi vehicle battery, the taxi toplight, the ignition switch, and a typical seat switch.

FIG. 5 illustrates the automobile battery B1, the taxi vacant and occupied toplights B12 and B11 respectively, the ignition switch B21, and typical seat switch B31, B32 and B33.

HEADLIGHT SWITCH CONNECTION AND TAXI TOPLIGHT

Figure 6:
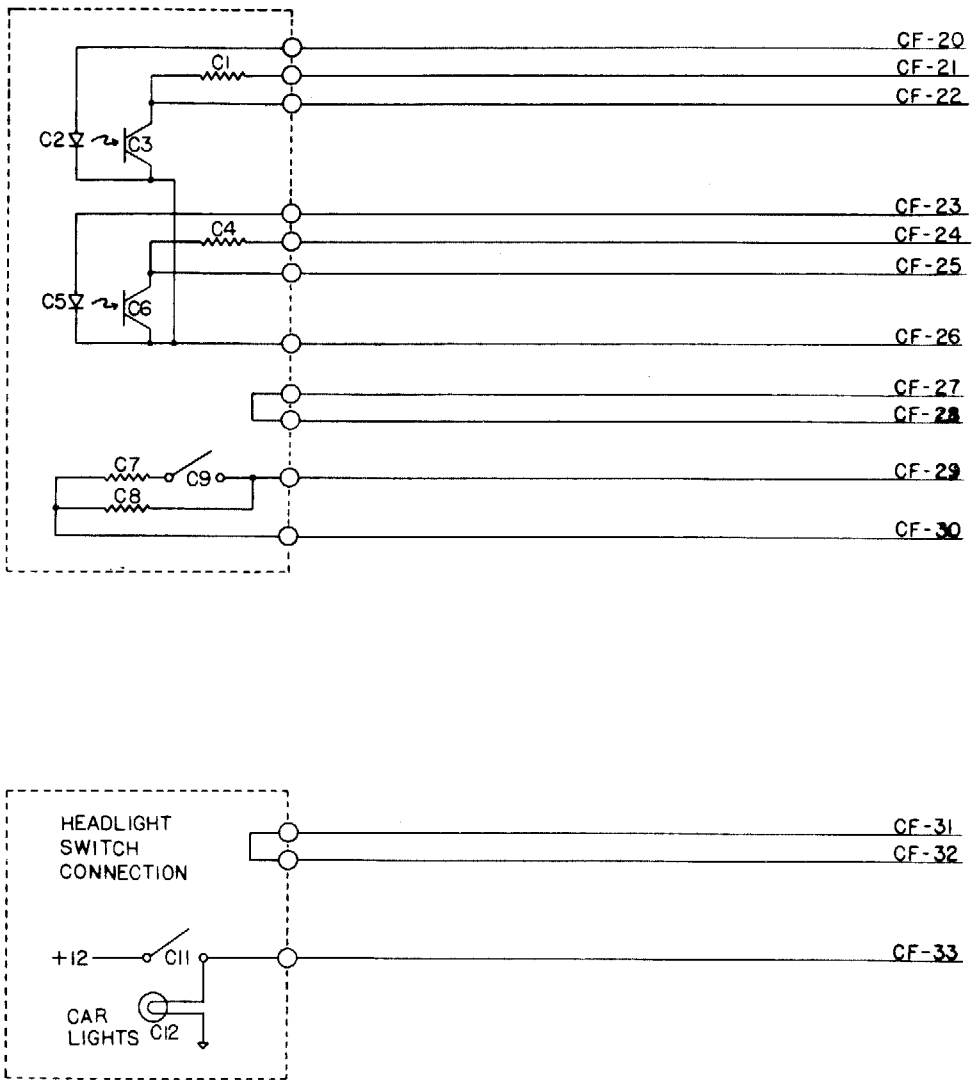
FIG. 6, sheet C, illustrates the electrical circuitry of the speed sensor of FIG. 3 and the connection to the headlight switch.
Figure 9:
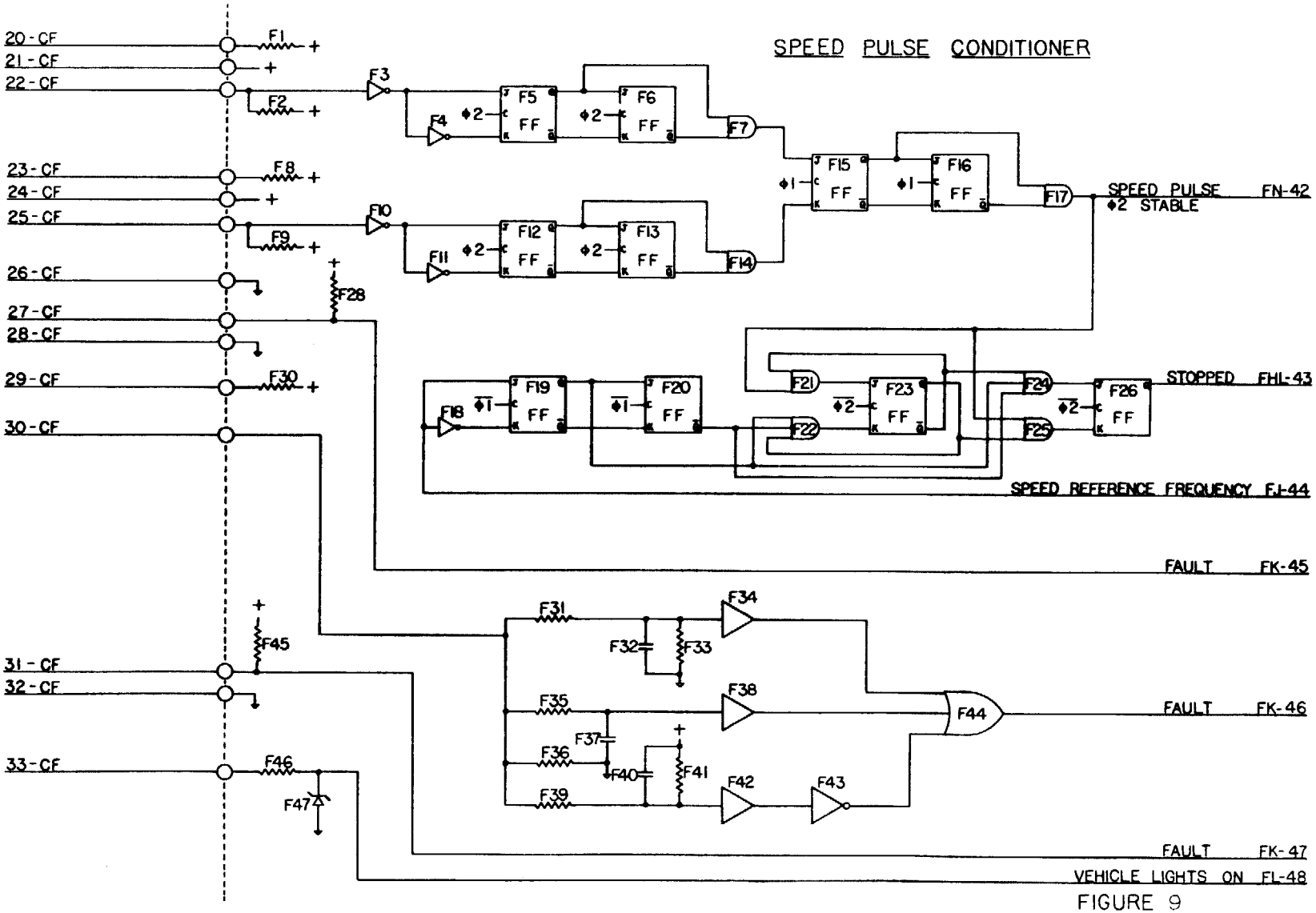
FIG. 9, sheet F, illustrates the speed pulse conditioner and speed sensor tamper interface.

A connection is made to the headlight switch C11 such that when the car lights C12 are turned on, current is loaded on lines 33-CF of FIG. 6. Resistor F46 and zener diode F47 of FIG. 9 are in place to protect the internal logic devices from damage. The line 48-FL then continues through a resistor and two buffers, L20, L21 and L22 of FIG. 14 and provides a logical high connecting to and gates L42 and L48. The inputs of L42 and L48 cause the taxi toplights to operate as follows. If the taxi lights are off, the low signals at L42 and L48 prevent the taxi toplights from lighting. However, if the taxi headlights are on, L42, L43, L44, L45, L46, and L47 cause the taxi toplight B12 that indicates the taxi is vacant to be lighted. The L48, L49, L50, L51 logic circuit caused taxi toplight B11 (that indicates that the taxi is already hired) to be lighted. In normal meter operation, only one, either B11, vacant or for hire, or B12, busy or hired, set of lights is on at any given time. The 0′ + 1′ feed to L42 or the 2′ + 3′ feed to L48 from JK flip-flops L23 and L24 determine which lights turn on as L23 and L24 indicates whether the taximeter is on and that, of course, indicates whether the taxi is free or occupied. The toplights respond to one other logic signal. Line 88-KLM going to the or gates L43 and L49 comes from the tamper scanner and indicates, when high, that the meter has been tampered. This high input, when placed on L43 and L49, causes the transistor circuits to turn on both B11, hired, and B12, for hire. The taxi toplight B11 and B12 then shows that the taxi is both busy and for hire, this configuration being used to show externally on the taxi that the meter is in a tampered condition. This tamper signal overrides normal toplight operation.

IGNITION SWITCH

When the taxi ignition switch B21 is turned on, the line 17 BE becomes loaded with +12 power. This +12 power line goes to the lights L69 and L72 which are inside of meter control switches G1, rate select, and G2, start meter. It provides the +12 power needed to run the two lights. Normally, the lights inside of all the manual taximeter control pushbutton switches are used to indicate whether the switch is working, light on, or is not working, light off. However, lights L69 and L72 are on when the meter is off; thus, whenever the taxi is parked and not in use, these two lights would remain on needlessly. To avoid this waste, their power is supplied by the ignition; thus, when the taxi is turned off, the lights go out. Both of these switches remain operational according to their normal pattern in spite of the lights being off. Also, this +12 power only goes to L69 and L72. It does not supply power for any other function of the taximeter system.

TYPICAL SEAT SWITCH

Several taximeter system functions make use of the passenger detection system through the use of seat switches of which B31, B32 and B33 is a typical seat switch. Since detecting passengers is vital to these functions, the seat switches have been provided with a special voltage level detection circuit capable of detecting tampers as well as normal switch operation. Line 18-BE carries current to the seat switch. If the switch B31 is open, no passenger, the circuit is completed through resistor B33 and the current returning on line 19-BE is fixed at a certain voltage level. If the switch B31 is closed, passenger present, the current returns through resistor B32 at a higher voltage level.

SPEED SENSOR CIRCUITRY

FIG. 6 illustrates the electrical circuitry of the speed sensor 100 in FIG. 3 using two pairs of phototransistors C2–C3, and C5–C6. C2 sends lights to C3 and C5 sends light to C6. A sensor 105 disc with notches in it passes between C2 and C3 and between C5 and C6. As the sensor disc 105 rotates, C3 and C6 receive light from their respective emitters during the times when there is a break in the disc and no light when the solid segment of disc is between the phototransistors and their emitters. Thus, as the disc 105 rotates, C3 and C6 output a set of pulses over lines 22-CF and 25-CF. These pulse trains are used to provide signals for the taximeter to compute speed and distance. Logic elements F3 through F17 of FIG. 9 are used to condition the incoming pulses from C3 and C6, and to provide a stable useable speed pulse from F17. Logic elements F18 through F26 are used to determine when the speed pulse of F17 falls below a certain level, minimum speed.

RESET INTERFACE CIRCUITRY

Figure 7:
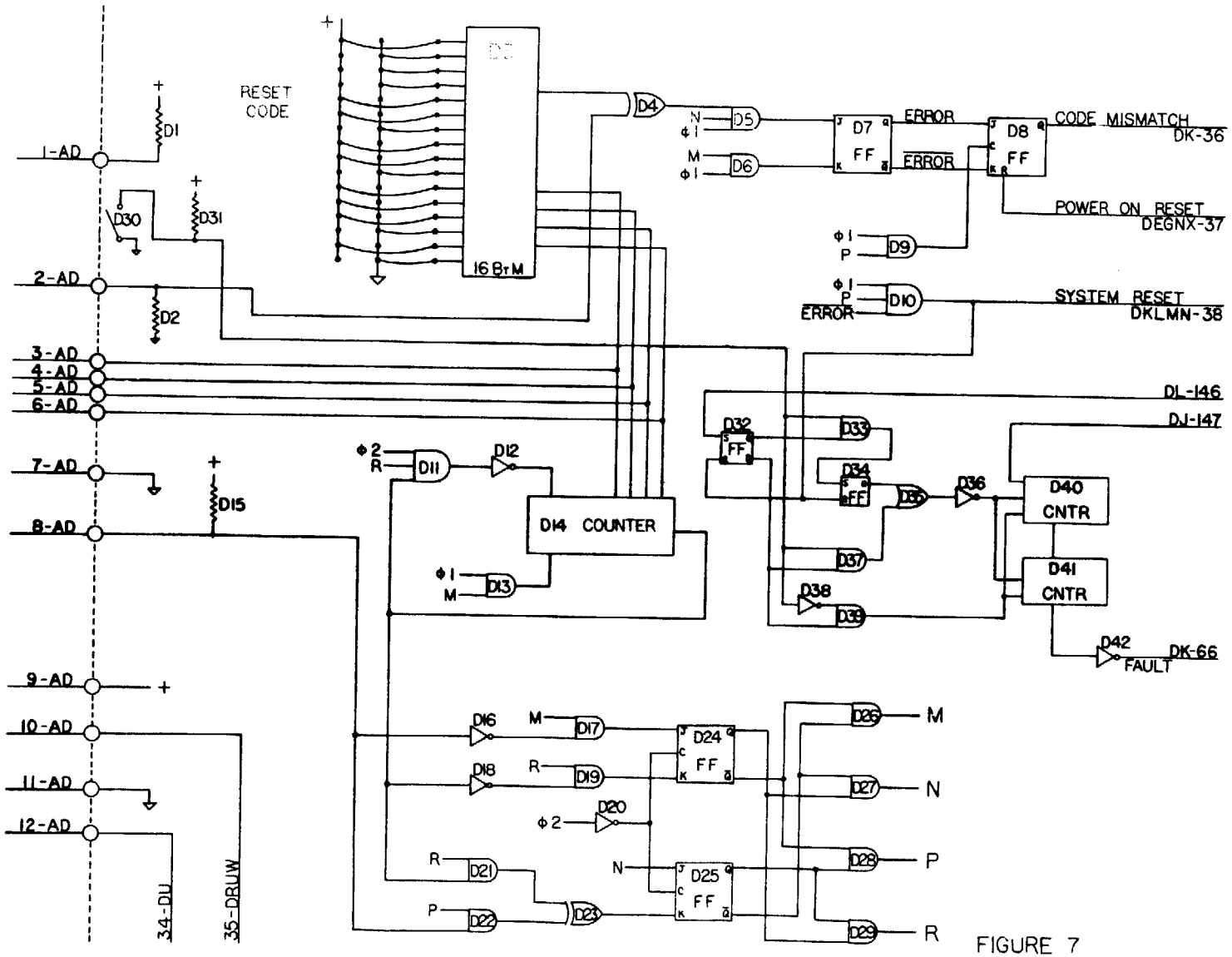
FIG. 7, sheet D, illustrates the reset interface circuitry.

FIG. 7 illustrates the reset interface circuitry showing mating connections with the external reset module 120 of FIG. 4. A binary coded decimal counter D14 compares the inputs of a 16 bit multiplexer D3 of the reset interface of FIG. 7 and the inputs from the 16 bit multiplexer A2 of the external reset module 120 of FIG. 4. If the two codes are identical, a system reset signal output results from and gate D10. If the codes in binary coded decimal counter D14 do not match, a code mismatch signal is emitted from JK flip-flop D8. A power on reset signal also feeds into the JK flip-flop D8. Logic elements of nor gate D4, and gates D5 and D6, JK flip-flop D7, and gates D9 and D10 interconnect to the 16 bit multiplexer D3 as shown in the drawings. And gate D11, an inverter D12, and gate D13, an inverter D16, and gate D17, an inverter D18, and gate D10, an inverter D20, and gates D21 and D22, an exclusive or gate D23, JK flip-flops D24 and D25, and and gates D26 through D29 all interconnect to binary coded decimal counter D14. The resistors D1 and D15 provide high inputs and resistor D2 provides a low input.

RESET-CALIBRATE ACCESS DETECTOR

FIG. 7 also illustrates a reset-calibrate access detector circuit for the reset-calibrate connector 134 of FIG. 2. The connector 134 is located on the meter face panel, having a cover plate over it to prevent free access to the connector terminals. This cover plate, not shown, is constructed in such a way that when it is in position it maintains switch D30 in the closed position. This can be done either by depressing the switch or maintaining a solid connection between two of the connector terminals so that they act like a switch. Whichever method is used, the switch is opened when the cover plate is removed to gain access to the connector. In any event, when the switch D30 is opened, pullup resistor D31 will cause a logic "1" to and gates D33 and D37 and inverter D38. Flip-flop D32 is fed a logic "1" to its S input whenever the taxi speed is equal to or greater than minimum speed and a logic "1" to its R input whenever the proper reset code is applied to the meter. This results in a high $\bar{Q}$ output once the taxi reaches minimum speed or a high Q output after a system reset while the taxi is stopped. Thus, if Q is high and switch D30 is opened, and gate D33 outputs a high that sets flip-flop D34 to a high Q output. If, Q is high and D30 is opened, D37 emits a high signal. When either Q of D34 or the output of D37 are high, or gate D35 emits a high and D36 inverts the signal. When the output of D36 is high, counters D40 and D41 are disabled. If D36 outputs low, counters D40 and D41 are enabled. Thus, when D36 outputs low, counters D40 and D41 start counting the time pulse of line 147-DJ culminating in a high signal from inverter D42 which goes to the tamper scanner K2 indicating a tamper.

When D32 outputs high at Q and switch D30 is open, the counters begin counting; however, if switch D30 is closed before the end of the count, inverter D38 outputs high causing D39 to go high to the counters, thereby stopping them and a fault signal. This is possible only after a system reset and before minimum speed, the state encountered when the taxi company is working on the meter. This makes it possible to open and close D32 without signaling a tamper. However, once minimum speed changes D32 to a high on Q, any opening of D30 will set Q of D34 high causing a manditory tamper to result.

D30 is arranged in a way that when the reset module 120 is in place D30 is held closed. Thus, after making a system reset, no tamper can occur. Furthermore, after the reset, the reset module 120 can be removed and if the cover plate is immediately put in place, closing D30, the counters are stopped short of a tamper. This system allows the company to do its work and rearm the detector circuit against tampering afterwards.

Since the anti-tamper system is a vital link in insuring meter integrity, this detector circuit makes the system even more secure. Additionally, since the tamper occurs after a time delay, the would-be-tamperer will likely assume wrongly as to what caused the tamper. This would be especially true if the time delay were set at say 10–20 minutes.

It is further desirable to use the lock that holds the meter in position in its case as a hold-down which must be removed before the cover plate can be removed. Thus, removing the cover plate would be a definitely planned tamper.

POWER INTERFACE, SEAT INTERFACE AND FAULT DETECTOR

Figure 8:
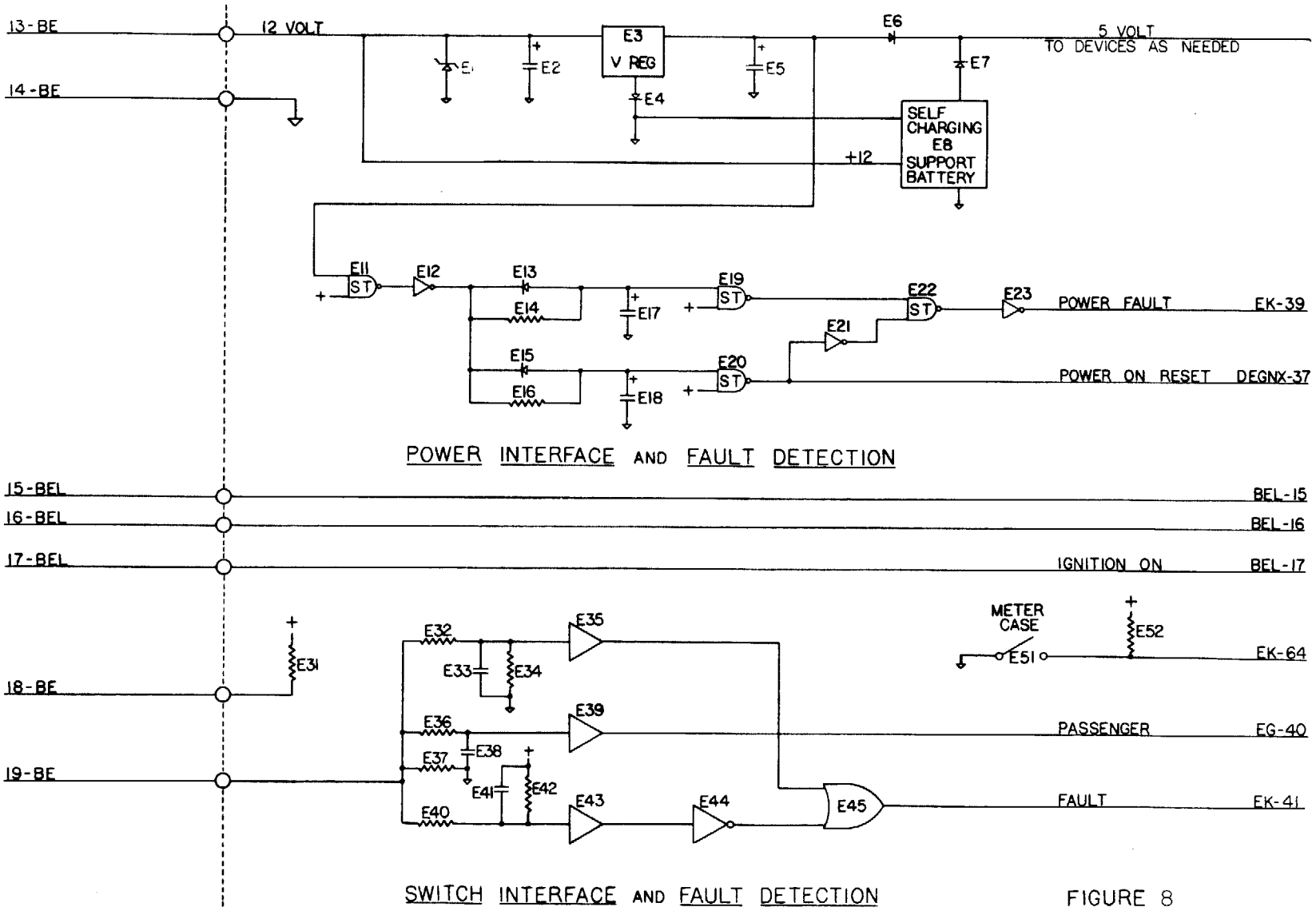
FIG. 8, sheet E, illustrates the power supply interface circuitry and seat switch interface circuitry.

FIG. 8 illustrates the power supply interface showing the external power connection for the taximeter from the vehicle battery. It provides constant power to the meter, independent of vehicle operations. The positive side of the battery feeds into line 13-BE and negative feeds to line 14-BE. Within the taximeter system, 14-BE is used to provide a common ground for the taximeter components. 13-BE provides plus power to a self-charging battery support supply E8 such as a Gates automatic hybrid battery charger module for charging as needed. This support supply is provided to keep the meter in operation in the event of a power tamper or failure. Diodes E4, E6 and E7 are needed to regulate the support supply's operation and prevent its discharge back to the vehicle during an external power disconnect. A zener diode E1, a capacitor E2, a voltage regulator E3 and another capacitor E5 provide for regulation and protection of the meter supply current. The logic line E24 provides the power to be used, as needed, by the taximeter system's components. In the event of a power failure or tamper, the output of the voltage regulator E3 will fall to 0. This is monitored by logic devices E11 through E23. The circuit of components E11–E23 uses a power up delay that results in two different outputs. If power is disconnected and reconnected, E23 will go high for a few seconds indicating a power fault and then go low indicating power is reestablished thereby removing the fault signal. At the same time, E20 issues a low for the first seconds after power is restored and then goes high to provide a power on reset signal for the system. The main function of the fault detection interface is to register a power fault so that the meter becomes disabled if power is disconnected.

A typical seat switch interface is provided to detect the returning voltage levels. Logic elements E32, E33, E34 and E35 of FIG. 8 detects high voltage levels as would occur if 18-BE were connected to 19-BE, by jumpwire, to bypass the resistors B32 and B33. On detecting a high level, noninverting hex buffer E35 issues a high output. Logic elements E40, E41, E42, E43 and E44 of FIG. 8 search for a voltage level that is lower than normal as would occur if the external circuit were opened. This detected, non-inverting hex buffer goes low and inverting hex buffer E44 inverts it to a high signal. A high on either inverting hex buffer E35 or inverting hex buffer E44 would be a tamper and cause or gate E45 to go high, signaling a tamper to the tamper scanner K1. Logic elements E36, E37, E38 and E39 of FIG. 8 detect the voltage level that occurs when B31 is closed and the circuit is completed through B32. This would cause a high output from buffer E39 to signal the presence of a passenger in the taxi. The circuit through B33 is at the normal no passenger voltage level and causes no change in the voltage level detectors thereby resulting in no output from the interface. Shown in FIG. 8 are switch E51 and resistor E52. Switch E51 is placed against the interior side of a meter access cover so that removal of the cover will allow switch E51 to go from closed to open. With switch E51 open, resistor E52 will bring line 64-EK high, thus signaling a tamper to scanner K2.

SPEED PULSE CONDITIONER

FIG. 9 illustrates the speed pulse conditioner and the speed sensor fault interface. Squarewave pulse trains 3B from the phototransistors C3 and C6 of FIG. 3 respectively go through inverters F3 and F10 for each pulse train, to inverters F4 and F11, into JK flip-flops F5 and F12, to JK flip-flops F6 and F13, to and gates F7 and F14, and join JK flip-flop F15 which connects to JK flip-flop F16, to logic and gate F17 to provide a speed pulse train. The output of and gate F17 and the speed reference frequency feed into circuitry consisting of inverter F18, JK flip-flop F19, JK flip-flop F20, logic and gates F21 and F22, JK flip-flop F23, logic and gates F24 and F25, and JK flip-flop F26 which outputs a stopped signal, also indicative of a speed below a minimum speed. Minimum speed may, for example, be ten miles per hour. The two different fault-detecting circuits are as follows: The first fault-detecting circuit, line 27-CF and 28-CF, is a line connected to ground with a pull-up resistor F28 on it. As long as the line remains grounded, it will stay low. If, however, any break occurs, the pull-up resistor F28 will bring the line high, and since it is hooked directly to the tamper-scanner, K-1 of FIG. 13, a fault signal occurs. The other fault-detecting circuit involves a switch C-9, in speed sensor 100 on FIG. 6. Switch C-9 is connected to speed sensor fault interface circuitry consisting of resistors F-31, F-32, F-33, F-35, F-36, F-39 and F-41, capacitors F-37 and F-40, non-inverting hex buffers F-34, F-38 and F-42, inverting hex buffer F-43, and or gate F-44 to output a fault signal. This circuitry is identical to that used for the seat switch interfaces, except that the closing of rwitch, C-9, is defined as a tamper. Thus, the closed switch, the high level and low level detectors are all faults. They are wired together with or gate F44, and any fault will then cause or gate F44 to go high to the tamper scanner K2 on FIG. 13.

SWITCH SYNCHRONIZERS AND DEBOUNCERS

Figure 10:
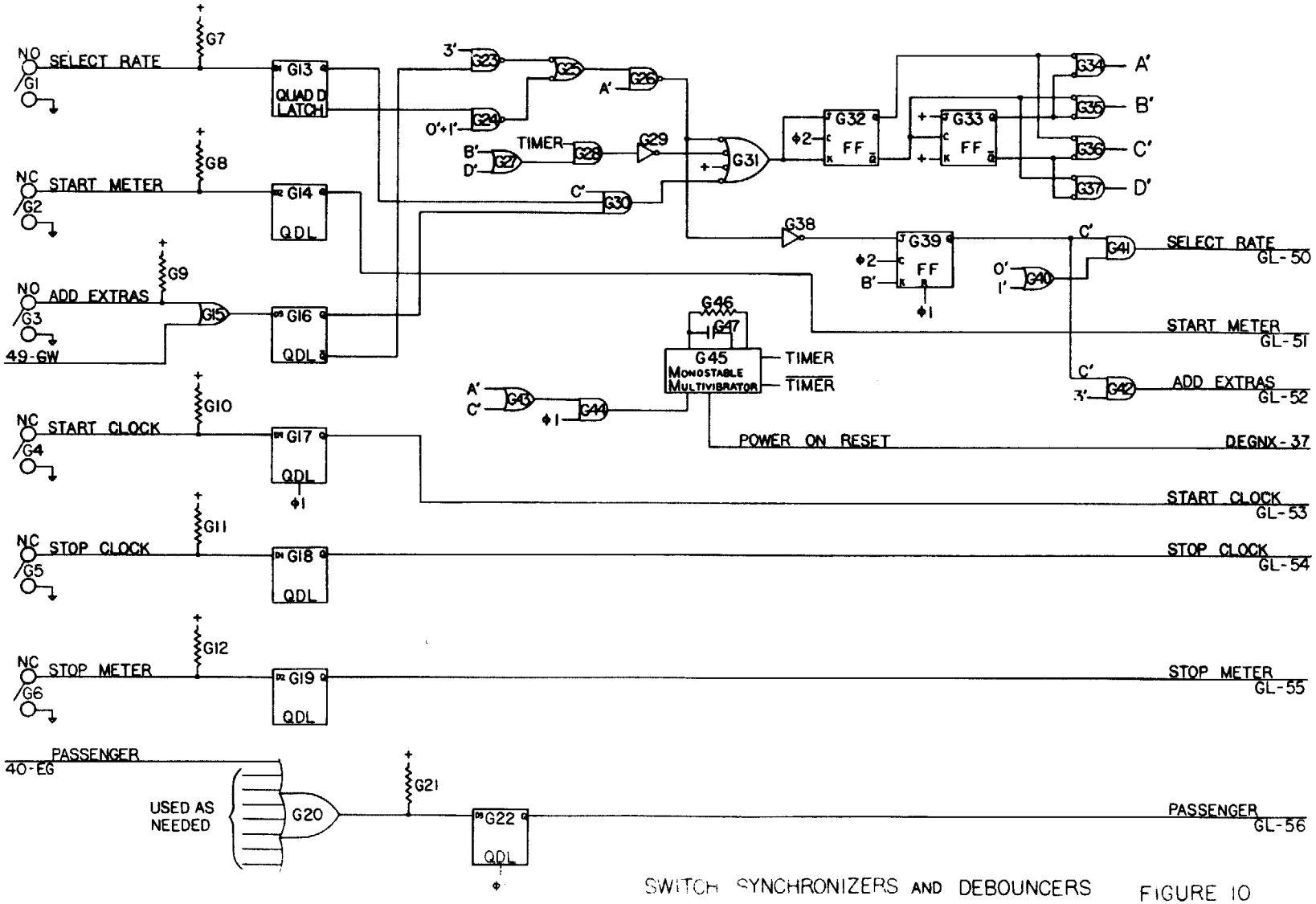
FIG. 10, sheet G, illustrates switch synchronizer and debouncer circuitry.

FIG. 10 illustrates switch synchronizing and debouncing circuitry used for the manual pushbutton switches on the taximeter face panel of FIG. 2. The manual pushbutton switches G1 through G6 on the taximeter face panel of FIG. 2 have resistors G7 through G12, respectively, and Quad-D latches G13 through G19 connected to each switch. Quad-D latches G13-G19 synchronize whether the switches will function or not. Connected to the switches G1 through G3 are a series of logic gates consisting of nand gates G23 and G24, nor gate G25, nand gate G26, or gate 27, and gate 28, inverter 29, and gate 30, nor gate 31, JK flip-flops G32 and G33, nand gates G34 through G37, inverter G38, JK flip-flop 39, or gate 40, and gate G41 and and gate G42, to provide output for the select rate, start meter and add extras. The outputs of nand gates G34 and G36 feed to logic or gate G43, and gate G44, monostable multivibrator G45, to provide a timing delay to the extras switch. Resistor G46 and capacitor G47 determine the timing of monostable multivibrator G45. The outputs of the Quad-D latches G17 through G19 determine the start clock, stop clock, and stop meter functions. Passenger seat signals from the passenger seat lines, 40-EG for example, of FIG. 8 go through or gate G20 and Quad-D latch G22 to output a passenger signal.

PASSENGER COUNTING CIRCUITRY AND AUTOMATIC EXTRAS

Figure 11:
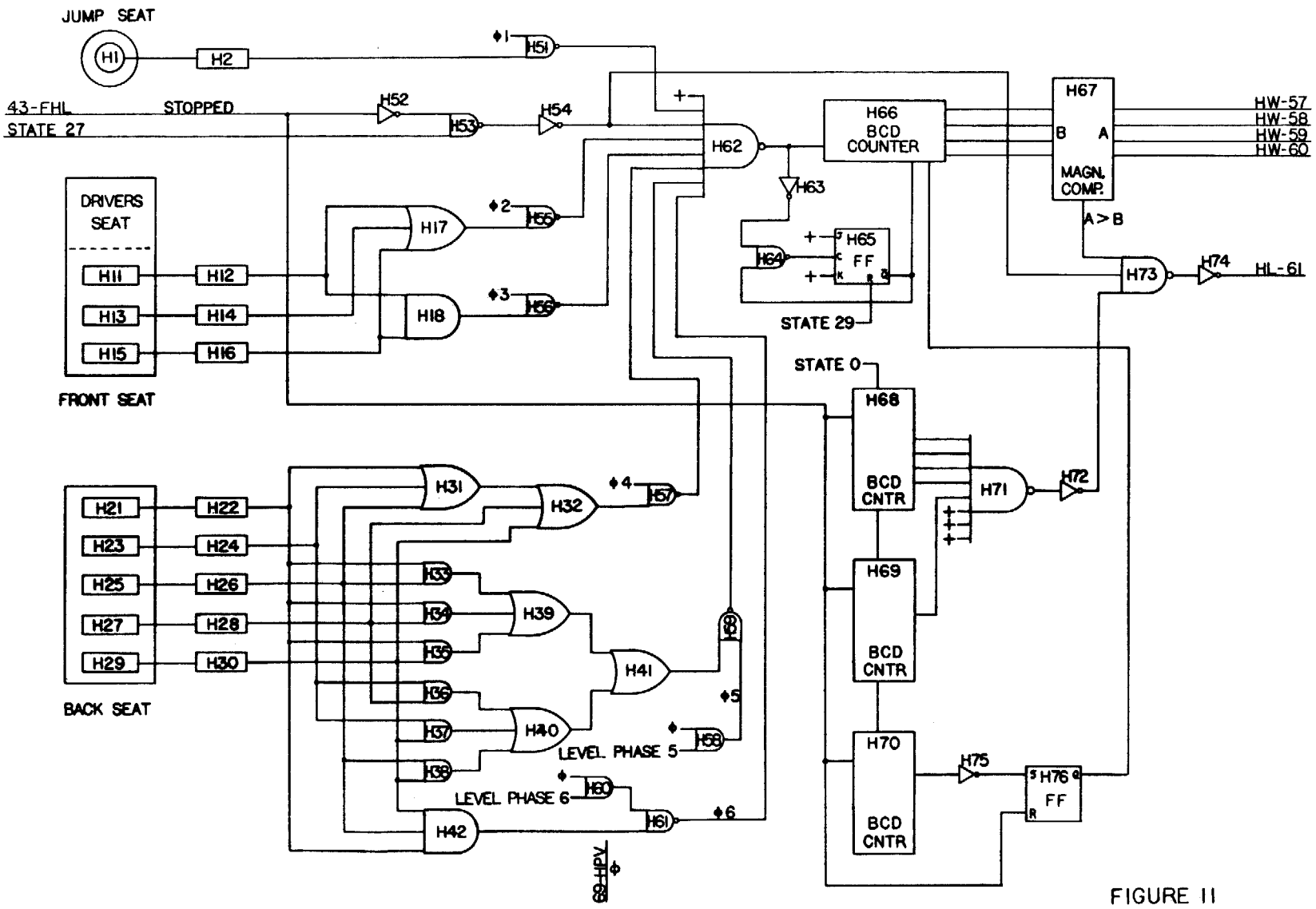
FIG. 11, sheet H, illustrates the passenger countign circuitry and automatic extras input circuitry.

FIG. 11 illustrates passenger counting circuitry and an automatic extras input circuit. H1, H11, H13, H15, H21, H23, H25, H27 and H29 are all typical seat switches, shown in detail in FIG. 5. H2, H12, H14, H16, H22, H24, H26, H28 and H30 are all seat switch interfaces, shown in detail in FIG. 8 and the outputs shown are the lines from each interface that indicate the presence of a passenger, see line 40-EG on FIG. 8 for an example.

PASSENGER COUNTING

Since H1 is a jumpseat, a high output from H2 indicates the presence of one passenger. However, in the front seat, while three seat switches H11, H13 and H15 are used in the seat, only two passengers are counted. Thus, or gate H17 is used to monitor all three interfaces H12, H14 and H16, and a high output from H17 indicates the presence of at least one passenger on the front seat. And gate H18 monitors H12 and H16, the outside switches, so that a high output from H18 indicates the presence of a second passenger. The rear seat is more complicated but the same principles hold true. Or gates H31 and H32 are used to monitor all of the rear seat switches so that a high output from H32 indicates the presence of at least one passenger on the seat. And gates H33 through H38 monitor all of the seat switch combinations, by common denominator, that must occur if a second passenger is on the seat. And gates H33-H38 are ored together by gates H39, H40 and H41 so that a high output from H41 indicates the presence of a second passenger on that seat. Likewise, and gate H42 monitors the seat switch combinations that must occur only if three passengers are on the seat so that a high output from H42 indicates the presence of the third passenger on the seat. The outputs of H2, H17, H18, H32, H41 and H42 each indicate the presence of one passenger. The sum of the high lines from H2, H17, H18, H32, H41 and H42 is equal to the total number of passengers in the taxi.

EXTRAS

Nand gates H51, H55, H56, H57, H59 and H61 combine each of the seat switch interface outputs with separate clock phases so that each gate goes low in sequence into nand gate H62. Line 43-FHL, taxi stopped, to inverter H52 enters a high to nand gate H53 whenever the taxi is over a predetermined minimum speed. State 27, extras pulse carries into extras adding function, see FIG. 24, also connects to H53 and to inverter H54 which connects to nand gate H62.

H62 then transmits the count signals to binary coded decimal counter H66 and inverter H63, nand gate H64 and JK flip-flop H65, which control the operation of counter H66 so that it ignores the first passenger signal, not an extra, and counts all of the rest. An extra is defined as every passenger in excess of 1. The count of H66 is transmitted to a magnitude comparator H67 where it is compared with the number of extras already charged on this trip. The number of extras already charged is read from counter W13 of FIG. 22 on lines 57-HW through 60-HW. If the number of extras already added is less than the number just counted on the seats, H67 outputs a high to nand gate H73. Also inputting to H73 is the output of H54, which is high when the taxi is over minimum speed during state 27, during which time extras can be added.

Binary coded decimal counters H68 and H69 count State 0's and feed nand gate H71 to inverter H72 which also goes to nand gate H73. These elements are used to force a time delay between each extras add output so that the occupants of the taxi can see and understand that extras are being added.

Or gate H77, binary coded decimal counter H70, inverter H75 and flip-flop H76 are used to disable binary coded decimal counter H66 after all of the extras counted have been added to the fare until such time as the taxi stops, since either discharging or adding passengers can only occur when the taxi is stopped.

Nand gate H73 outputs to inverter H74 which in turn (via line 61-HL) feeds to or gate L87 which ors together manual extras with the automatic extras described here. This makes it possible for the driver to manually input extras charges at the beginning of the trip or have this system to do it automatically if he doesn't or there are changes in the number of extras thereafter. Manual extras is still disabled for the rest of the trip with the first minimum speed pulse. Thereafter, any changes in the number of extra passengers will be handled by the automatic extras system. All of the seat switch interfaces in use also have their passenger outputs, see example E39 of FIG. 8 connected to or gate G20 of FIG. 10. In this way, a high output on the passenger line of any seat switch interface will be received by G20, whose high output will then be used for control logic operations.

CLOCK GENERATOR

FIG. 12 illustrates the 32 phase clock generator, time reference, and speed reference. The 200 kilohertz crystal J-1 is used in an astable and multivibrator configuration of end connected nand gates J3 and J4 to inverter J8, JK flip-flop J9. The JK flip-flop J9 divides the fundamental frequency by a factor of 2. Inverters J10 through J16 then provide a 100 kilohertz reference frequency. Their phase not output feeds to JK flip-flops J30 through J34 and through respective inputs of decoders J35 and J36 to obtain proper level phases. The phase output feeds to and gate J17 to inverter J18, to binary coded decimal counters J19 through J23 to respective nand and and gates J24 and J25 to a divide by N counter J29 to produce a speed reference frequency which goes into the speed pulse conditioner of FIG. 9 at inverter F18. The level phases of the decoder J35 and J36 feed into the eight input gates J37 through J39 and J49. Various set outputs are produced by and gates J40, J42, J43 and or gate J41, in addition to the outputs of and gate 50 and JK flip-flop J51 and J52. All of these additional output combinations are later used in the logic circuitry to be further described. In conjunction with the previously described circuitry, logic inverter J44, nand gate J45, inverter J46, inverter J47, JK flip-flop J48 and and gates J54 through J61 are used to provide various level stages.

FAULT SCANNER

Figure 13:
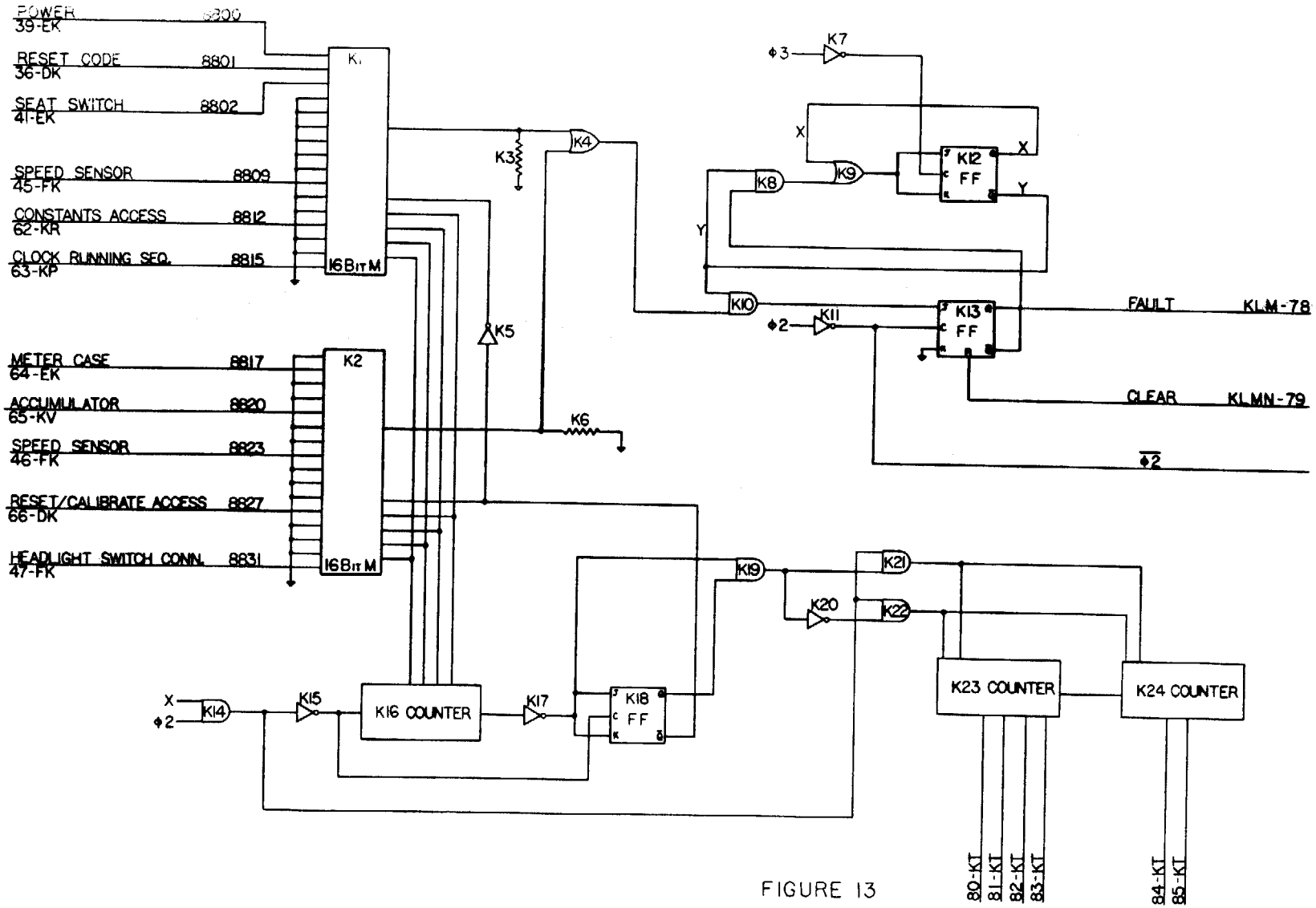
FIG. 13, sheet K, illustrates the tamper and fault scanner circuitry.

FIG. 13 illustrates the tamper and fault scanner circuitry. All of the various fault and tamper detectors, such as power, reset code, seat switch, speed sensor, meter box, constants access, clock running sequencer, accumulator and reset-calibrate access, connect into two 16-bit multiplexers K1 and K2, which are wired to scan for fault and tamper signals. When a high line is detected, one of the two multiplexers stops on the high line and outputs a tamper signal to binary coded decimal counter K16 to feed through JK flip-flop K18 to binary coded decimal counters K23 and K24 to be decoded as a constant to indicate a tamper code number for one of the eleven designated tampers and faults. Scanning lines of the multiplexers K1 and K2 can also be wired into seat tamper switches to scan for seat tampers, such as lifting the seat to gain access to the seat switch circuitry, and also wired into the taximeter in other ways to scan for malfunctioning portions of the taximeter system. There are several independent seat switches and the multiplexers allow for an input of 32 different tampers or malfunctions which may be detected. If more tamper detection is desired, additional multiplexers can also be added. The output of the multiplexers K1 and K2 feed to nor gate K4, and gate K10, into JK flip-flop K13 to indicate a fault which signals the logic circuitry of the taximeter to disable the taximeter from operation. The clear signal comes from the reset interface of FIG. 7. Other logic circuitry of and gate K8, or gate K9, inverter K7, and JK flip-flop K12 provides further logic circuitry to produce a fault signal from JK flip-flop K13.

CLOCK START AND STOP SEQUENCING

FIG. 14 illustrates the clock start and stop sequencing circuitry. An inverter L31, and gate L32 and or gate L33 combine the stop meter 55-GL and system reset logic 38-DKLMN inputs to provide a clear output. And gates L34 and L35 and a JK flip-flop L39 provides a logic input between the select rate logic switch and the rate select. And gate L41 and or gate L87 provide logic interface between the manual extras switch or automatic extras, the extras record counter, and the extras displayed on the meter face. The inverter L1, and gate L3, or gate L13, and JK flip-flop L23 produce clock states through and gates L25 through L28. An or gate L2 through and gate L3 to or gate L13 to JK flip-flop L23 provides logic interface to the output states of and gates L25 through L28. An inverter L5 connects from the passenger or gate G20 of FIG. 10 through the inverter to and gates L6 and L8 to or gates L13 and L14 to JK flip-flop L23. Start meter 51-GL connects to the inverter L7, to and gate L8, to or gate L14, and to JK flip-flop L23. The stop clock 54-GL connects to and gate L9, or gate L14, JK flip-flop L23. State 9, which performs distance computation connects to or gate L11, and gate L12, or gate L15, and to JK flip-flop L24. State 2 signal connects to or gate L18, to inverter L19, to and gate L66, and to and gate L83, to start meter and stop meter internal lights on the switches. Headlights connect to inverters L21 and L22, to and gate L42, or gate L43, switching transistors L46 and L47 to switch vacant top light B-12. Lights L57, L65, L69, L72, L75, L78, L82, and L86, labeled in FIG. 14 of the drawing, are turned on through switching transistors L56, L64, L68, L71, L74, L77, L81, L85, respectively. Other appropriate direct wire logic connections are illustrated in the drawing.

ARITHMETIC PROGRAM

Figure 15:
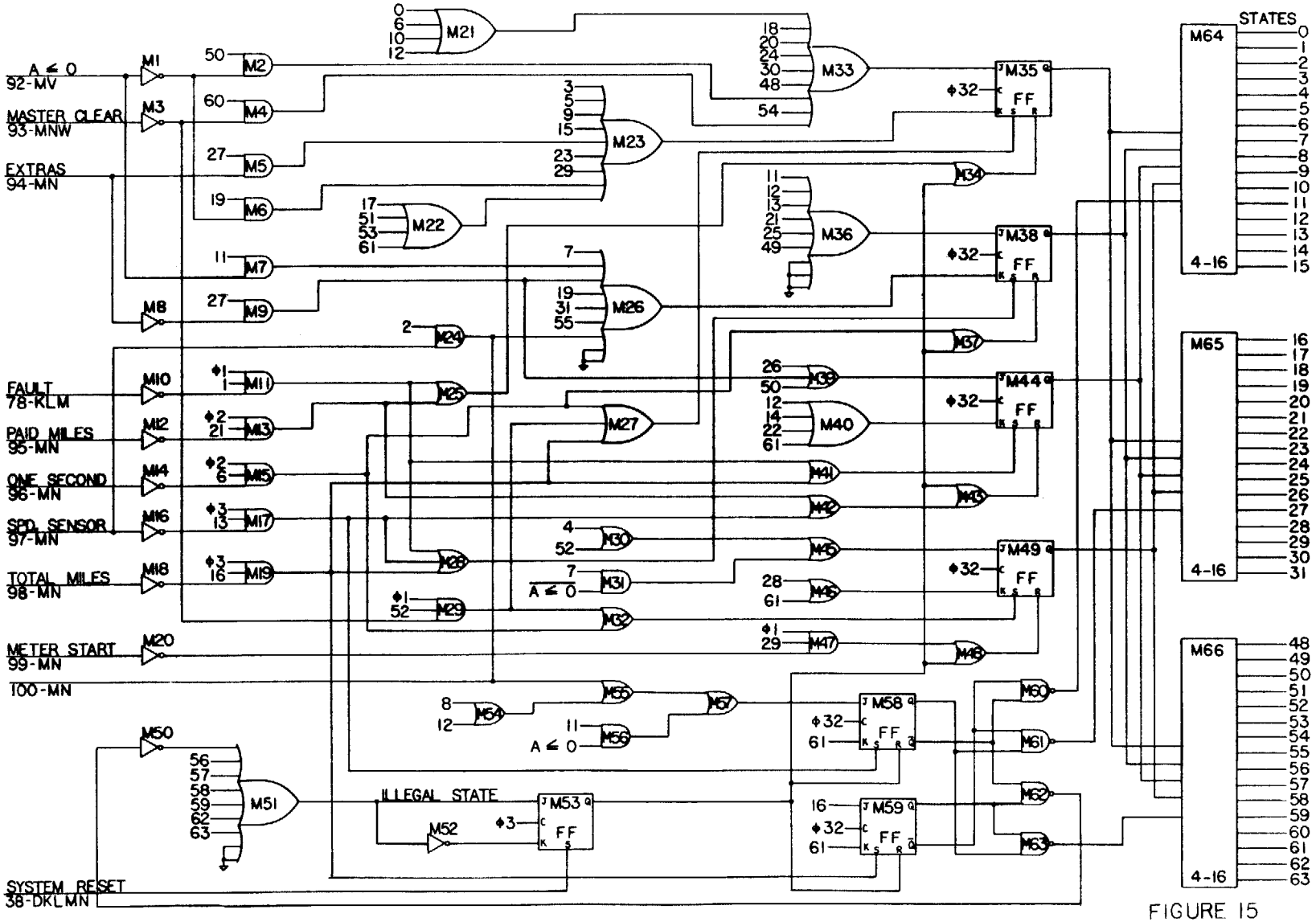
FIG. 15, sheet M, illustrates the program arithmetic circuitry.
Figure 16:
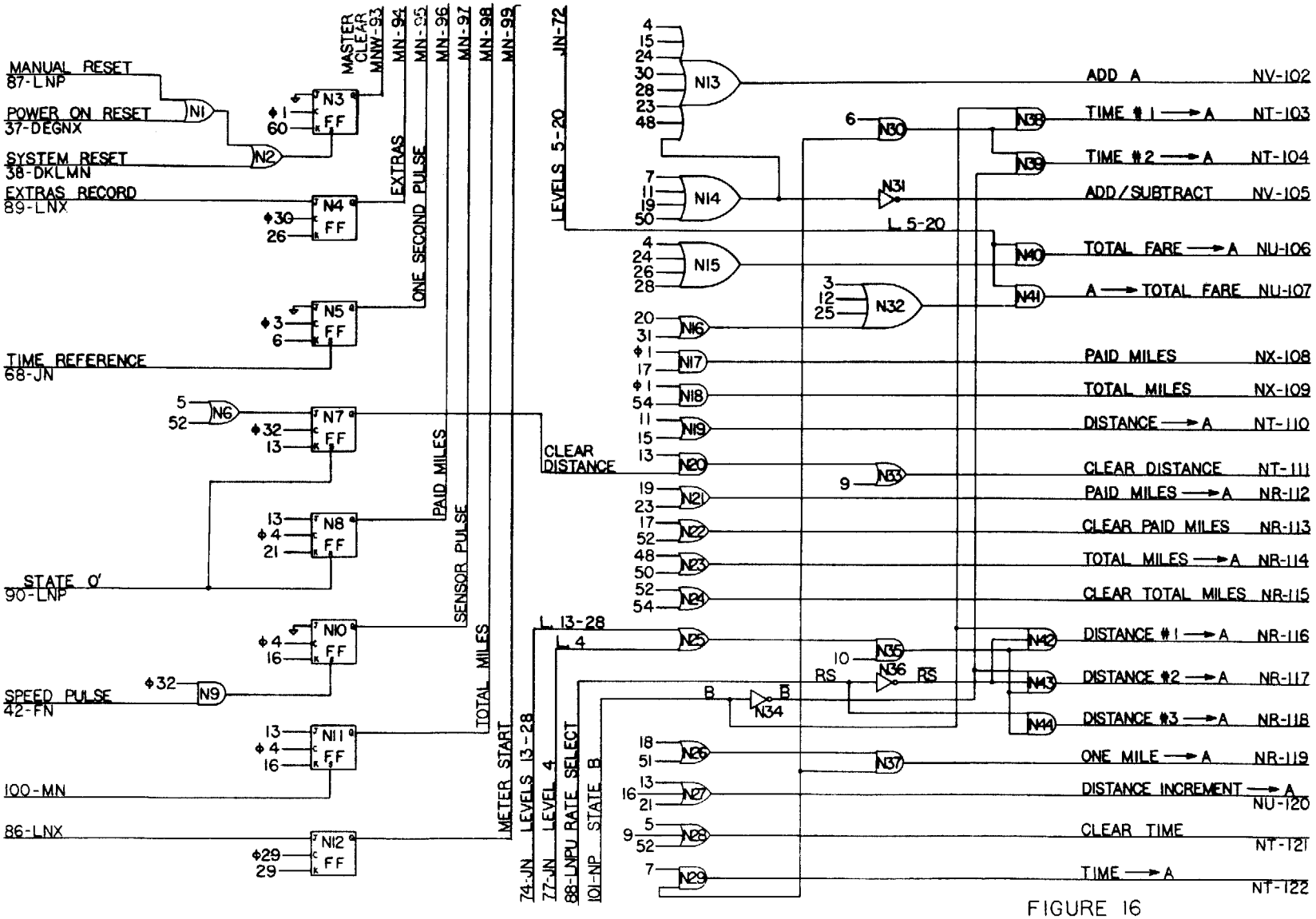
FIG. 16, sheet N, illustrates the control logic decoding circuitry.

FIG. 15 illustrates the program arithmetic circuitry. M64 to M66 are four to sixteen line decoders that generate the output states for the various operations shown in the state transistion table for the arithmetic section of FIG. 24. FIG. 16 illustrates the control logic decoding circuitry. The program arithmetic circuitry of FIG. 15 and the control logic decoding circuitry of FIG. 16 coenact to control the operation of the arithmetic for the taximeter system. The specific step by step arithmetic transitions provided by the circuitry of FIGS. 15 and 16 can be more clearly understood by reference to the State Transition Table of FIG. 24 which displays the transitions resulting from operation of the arithmetic program of FIG. 15. FIG. 15 shows logic inputs feeding into inverters M1, M3, M8, M10, M12, M14, M16, M18, M20, feeding respective and gates M2, M4, M5, M6, M7, M9, M11, M13, M15, M19, which respectively connect into or gates M22, M25, M28 and and gates M24 and M29, to subsequent or gates M23, M26, M27, M30, M31, and gate M32, to other or gates M33, M36, M39, M40, M41, M42, M45, M47, M34, M37, M43, M48, to JK flip-flops M35, M38, M44, M49, to be fed into the four to sixteen line decoders M64 through M66, whose state outputs are connected to the other gates as labeled. The output of nand gate M62 is inverted by M50 whose output and states 56, 57, 58, 59, 62 and 63, input to or gate M51. M51 feeds the J input of JK flip-flop M53 and is inverted by M52 which feeds the K input of M53, with a system reset input on the set input of M53. The Q output of M53 connects to JK flip-flops M58 and M59 along with the output of or gates M54 and M55 and gate M56 and or gate M57. JK flip-flops M58 and M59 feed nand gates M60, M61 M62 and M63 which in turn feed four to sixteen line decoders M64 through M66.

CONTROL LOGIC DECODING

FIG. 16 illustrates the control logic decoding circuitry. Three logic inputs from manual reset, power on reset and system reset and state 60 feed JK flip-flop N3 which outputs a master clear pulse. Additionally, an extras record input and state 26 feed JK flip-flop N4 which outputs an extras pulse, a time reference input and state 6 feed JK flip-flop N5 which outputs a one second pulse, states 5 and 52 feed or gate N6 whose output and a state 13 feed JK flip-flop N7 which outputs a clear distance pulse, states 13, 21 and 0' feed JK flip-flop N8 which outputs a paid miles pulse, a speed pulse and state 16 feed JK flip-flop N10 which outputs a sensor pulse, the output of and gate M24 and states 13 and 16 input to JK flip-flop N11 which outputs a total miles pulse, and the output of or gate L15, the combination of all meter start methods, and state 29 input to JK flip-flop N12 which outputs a meter start pulse.

Figure 17:
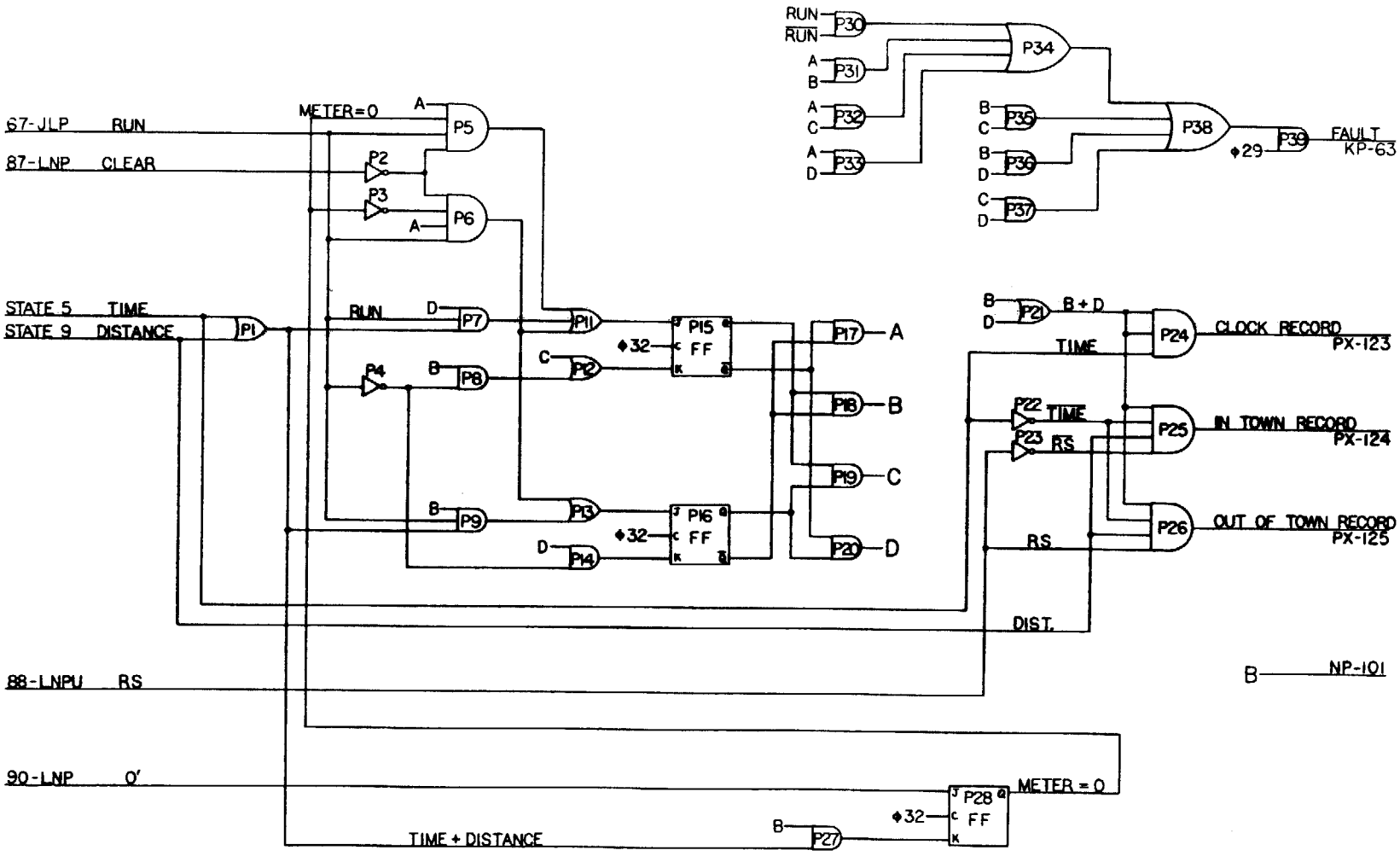
FIG. 17, sheet P, illustrates the clock running sequencer circuitry.

State outputs from the four to sixteen line decoders M64 through M66 of FIG. 15, logic inputs levels 5–20, levels 13–28 and level 4 of FIG. 12, a rate select input of FIG. 14 and a State B input of FIG. 17 feed into the or gates N13, N14, N15, N16, N17, and gates N17 and N18, or gate N19, and gate N20, or gates N21 through N28 and and gate N29. Other respective logic circuitry of and gate N30, inverter N31, or gate N32, or gate N33, inverter N34, and gate N35, inverter N36, and gate N37, and gates N38 through N44, respectively, provide outputs for the instructions to the accumulator as appropriately labeled in FIG. 16 of the drawings.

CLOCK RUNNING SEQUENCER

FIG. 17 illustrates the clock running sequencer circuitry. A run signal, clear signal, time signal, distance signal, rate-select signal, and zero prime signal of FIG. 14 feeds into an and gate P5, an inverter P2, an or gate P1, an inverter P23 and a JK flip-flop P28, respectively. The output of the JK flip-flop P28 feeds into and gate P5 and inverter P3 which feeds into and gate P6. Time and distance signals feed into or gate P1, whose output feeds into and gate P7, whose output is fed into or gate P11 in conjunction with the outputs of and gates P5 and P6 to feed into the J input of the JK flip-flop P15, whose Q output feeds into and gates P18 and P19. The output of inverter P4 feeds and gate P8 which feeds into or gate P12 which feeds the K input of the JK flip-flop P15, whose Q not output feeds into and gates P17 and P20. The output of and gate P9 feeds into or gate P13 which feeds into the J input of JK flip-flop P16 and the output of and gate P14 feeds into the K input of JK flip-flop P16 which feeds into and gates P19 and P20 for the Q output of the JK flip-flop P16, and and gates P17 and P18 for the Q not out of JK flip-flop P16. The outputs of and gates P17, P18, P19 and P20 feed back into, respectively, and gates P5, P6, P7, P8, P9 and P14 and or gate P12. The Rate Select signal feeds into and gate P26 and inverter P23, whose output feeds into and gate P25. The time and distance signals also feed into logic circuits of and gate P24, inverter P22, and gate P25 and and gate P26 to produce a clock record output signal from and gate P24, an in-town record signal from and gate P25, and an out-of-town record signal from and gate P26. These three outputs indicate that an add has occurred and instruct the control circuitry for the counters to count, which will be further described.

CLOCK SEQUENCER FAULT

FIG. 17 also illustrates logic circuitry P30 through P39. Its purpose is to detect an operational fault if such occurs in the clock running sequencer circuitry. And gates P30, P31, P32, P33, P35, P36, and P37 are sets of circuit combinations and the satisfaction of any of them would indicate a fault. The outputs of P30, P31, P32, P33, P35, P36 and P37 connect to or gates P34 and P38 so that a high output from P38 would be a fault. The output of P38 is combined with $\phi$29 into and gate P39 to insure greater signal accuracy, since the high of P38 would have to stay high a long time before $\phi$29 occured. Thus, a high output from P39 on line 63-KP would be a sure system fault that would be sent to scanner K1.

CONSTANT AND STORAGE

Figure 19:
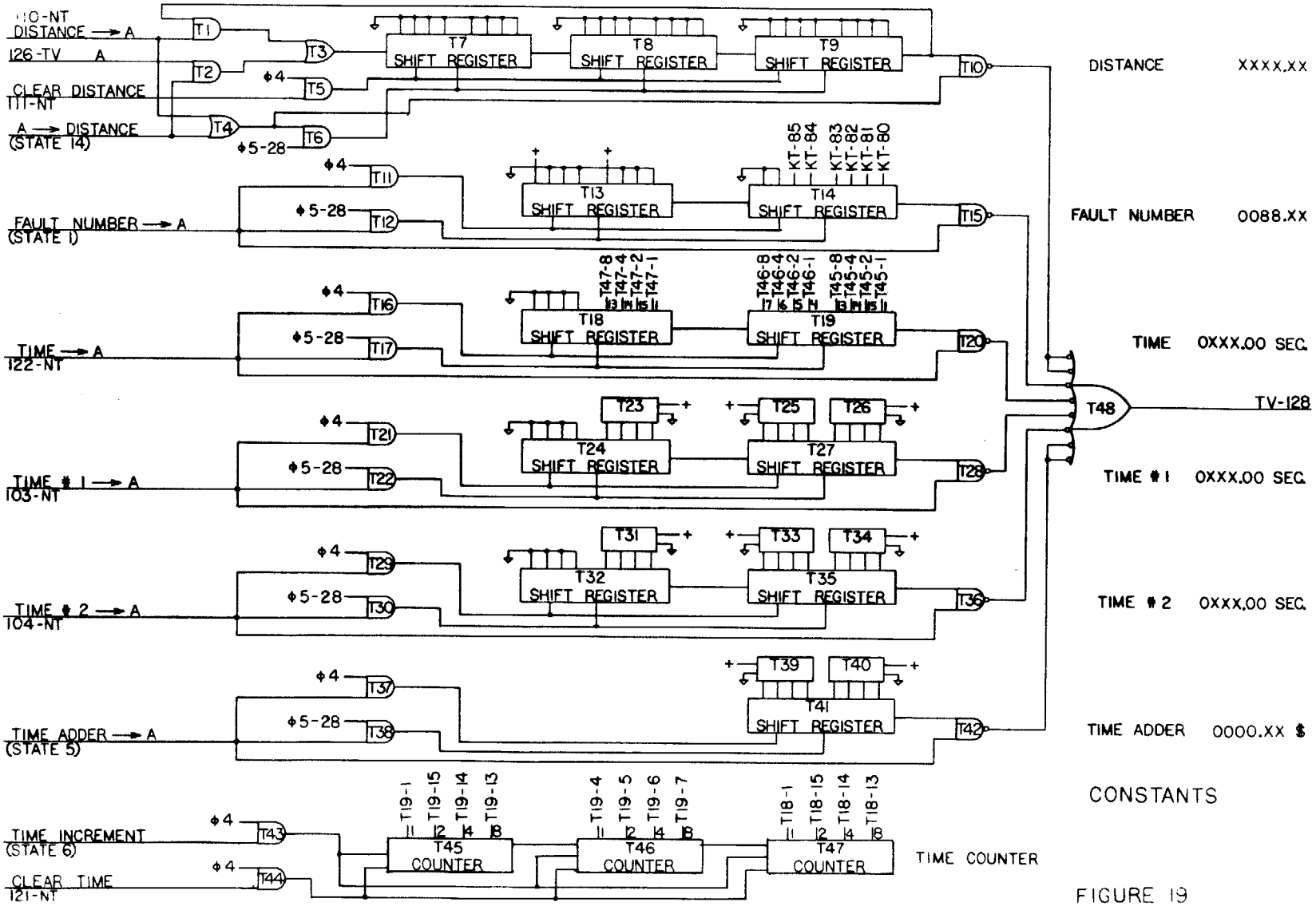
Figure 20:
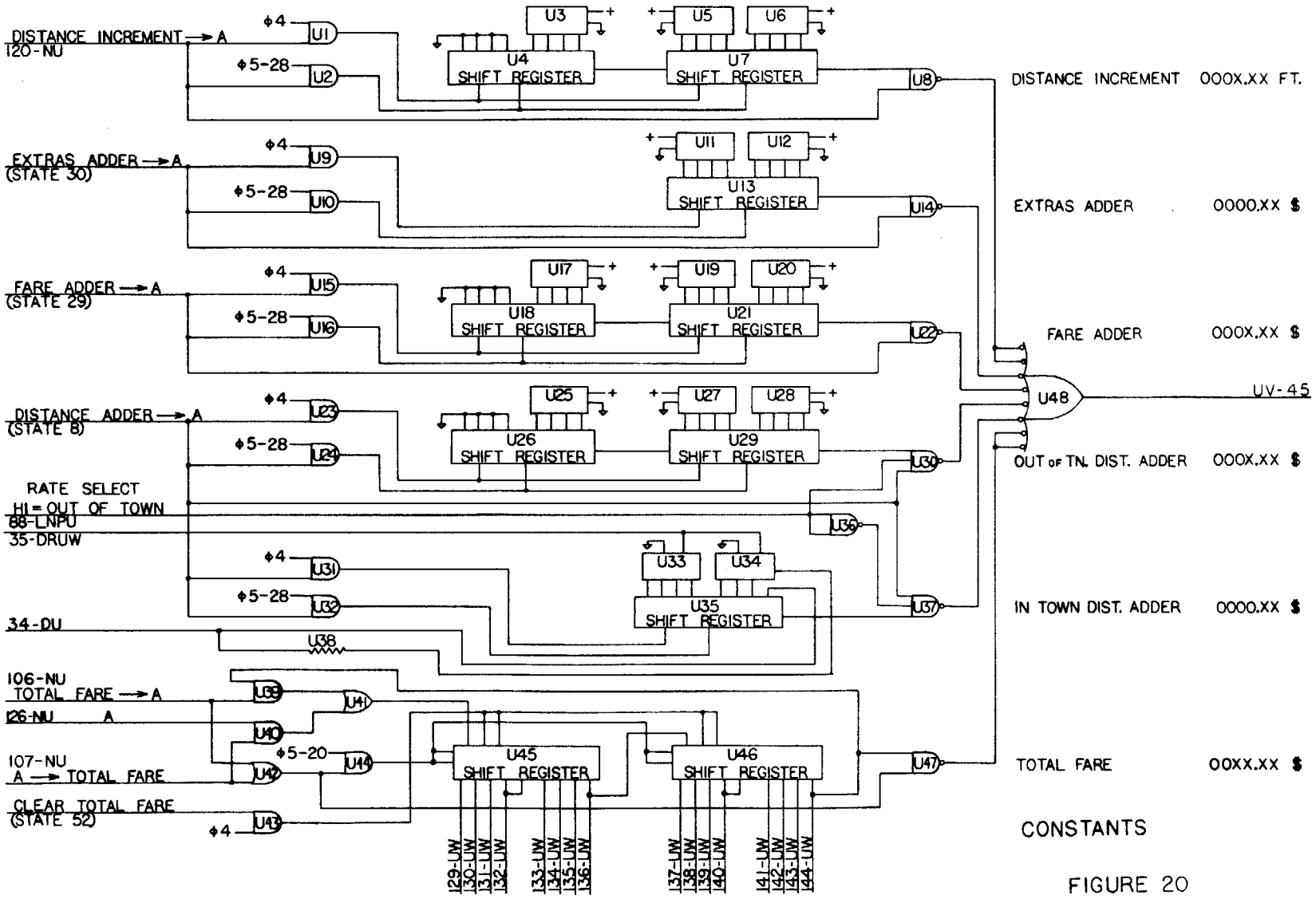

FIGS. 18, 19 and 20 illustrate the constant and storage circuitry.

FIG. 18 illustrates distance 1 into accumulator, distance 2 into accumulator and distance 3 into accumulator feeding into and gates R1, R2, R10, R11, R19 and R20, subsequently feeding into eight-bit shift registers R8, R9, R14, R17, R23, R26, feeding out to nand gates R7, R18, R27, respectively, to nor gate R53. Binary coded decimal switches R3, R4, R5, R6, R12, R13, R15, R16, R21, R22, R24, R25 feed into the eight-bit shift registers, respectively, R8, R9, R14, R17, R23 and R26. These switches and their shift registers give the accumulator of FIG. 21 the numbers it needs to compute the distance which elapses. The next line is the one-mile constant having and gates R28, R29, having eight-bit shift registers R30 and R31 tied for one-mile, 5280 feet, feeding to a nand gate R32 to nor gate R53, to determine when one mile has elasped. The input signals of accumulator into paid miles, accumulator, clear paid miles and paid miles into accumulator feed into and gates R33 and R34, or gates R35 and R36, and gates R37 and R38, appropriately wired to eight-bit shift registers R39 through R41 to nand gate R42 into nor gate R53 to determine the total miles elapsed when the meter is charging a taxi fare. The input signals of total miles into accumulator, accumulator, clear total miles and accumulator into total miles feed into and gates R43 and R44, or gates R45 and R46, and gates R47 and R48, respectively wired to eight-bit shift registers R49 through R51, whose outputs feed to a nand gate R52 and to nor gate R53 to determine the total miles which the taxi travels. Switch R62 and resistor R61 react exactly the same as E51 and E52 of FIG. 8 as described above. Switch R62 is placed so as to detect the removal of a cover in place over the constants switches. Thus, if that cover is removed to gain access to the constants switches, line 62-KR will go high and signal tamper scanner K1.

FIG. 19 illustrates additional constant and storage circuitry. At the bottom of FIG. 19 are a time increment input and a clear time input which feed into and gates T43 and T44, respectively, which subsequently feed into binary coded decimal counters T45, T46 and T47. The outputs from the binary coded decimal counters feed into eight-bit shift registers T18 and T19. A time into accumulator line feeds into and gates T16 and T17 to feed into eight-bit shift registers T18, T19, into nand gate T20 and nor gate T48. Fault number into accumulator, time number 1 into accumulator, and time number 2 into accumulator signals feed into pairs of and gates T11 and T12, T21 and T22, T29 and T30 to feed into pairs of eight-bit shift registers T13 and T14, T24 and T27, T32 and T35, whose outputs feed into nand gates T15, T28, T36, where the outputs are respectively fed into nor gate T48. Signals from the control logic decoding of FIG. 16, that is, elapsed distance into accumulator, accumulator, accumulator into distance, and clear distance, feed into and gate T1, and gate T2, or gate T3, or gate T4, and gate T5, and gate T6, eight-bit shift registers T7, T8 and T9, and nand gate T10 into nor gate T48. Time adder into accumulator, the input from the control logic decoding of FIG. 16, feeds into and gates T37 and T38, into eight-bit shift register T41, into nand gate T42, and subsequently into nor gate T48. Eight-bit shift registers T24, T27, T32, T35 and T41 receive constants numbers from binary coded decimal input switches T23, T25, T26, T31, T33, T34, T39 and T40. Shift register T14 receives the outputs from binary coded decimal counters K23 and K24 that indicate a tamper number.

FIG. 20 illustrates additional constant and storage circuitry. Inputs from the control logic decoding section of FIG. 16 feed into the left-hand side of FIG. 20 to provide control over the constant inputs. The distance increment into accumulator feeds into and gates U1 and U2 into eight-bit shift registers U4 and U7 to nand gate U8 into nor gate U48. Binary coded decimal switches U3, U5, and U6 provide constant inputs to the shift registers U4 and U7. The distance increment is used for calibration. It equals the number of feet traveled by the taxi in one revolution of the sensor disc. The extras adder into accumulator feeds into and gates U9 and U10, eight-bit shift register U13, and nand gate U14 into nor gate U48. Binary coded decimal switches U11 and U12 feed into the eight-bit shift register U13 to provide constant input. The extras adder is the amount of money added to the fare when there is an extras input, such as extra passengers greater than one. Fare adder into accumulator instruction feeds into and gates U15 and U16, respectively into eight-bit shift registers U18 and U21, to nand gate U22, into nor gate U48. Binary coded decimal switches U17, U19 and U20 provide constants inputs to the eight-bit shift registers U18 and U21. The fare adder is the "flag thrown" amount which is the minimum pick-up fee for a customer hiring the taxi. Instructions, which are distance adder, rate select for out-of-town and calibrate feed into and gates U23, U24, U31 and U32, electrically connected to eight-bit shift registers U26, U29, U35, connected to nand gates U30, U36, U37, feeding into nor gate U48. Binary coded decimal input switches U25, U27, U28, U33 and U34 provide constant input into the shift registers U26, U29 and U35, respectively. These instructions, operating in conjunction with the logic circuitry, provide out-of-town distance adder amounts and in-town distance adder amounts for each increment of a mile, according to whatever rate is appropriate for the trip being hired. Signals from the control logic decoding of FIG. 16, those of total fare into accumulator, accumulator, accumulator into total fare and clear total fare feed into and gate U39, and gate U40, or gate U41, or gate U42, and gate U43, and gate U44, eight-bit shift registers U45 and U46, nand gate U47 and subsequently into nor gate U48. Shift registers U45 and U46 store total fare data and make output on lines 129-UW through 144-UW to decoder drivers W15, W17, W19, W21 of FIG. 22 to display the fare.

ACCUMULATOR AND FAULT DETECTOR

Figure 21:
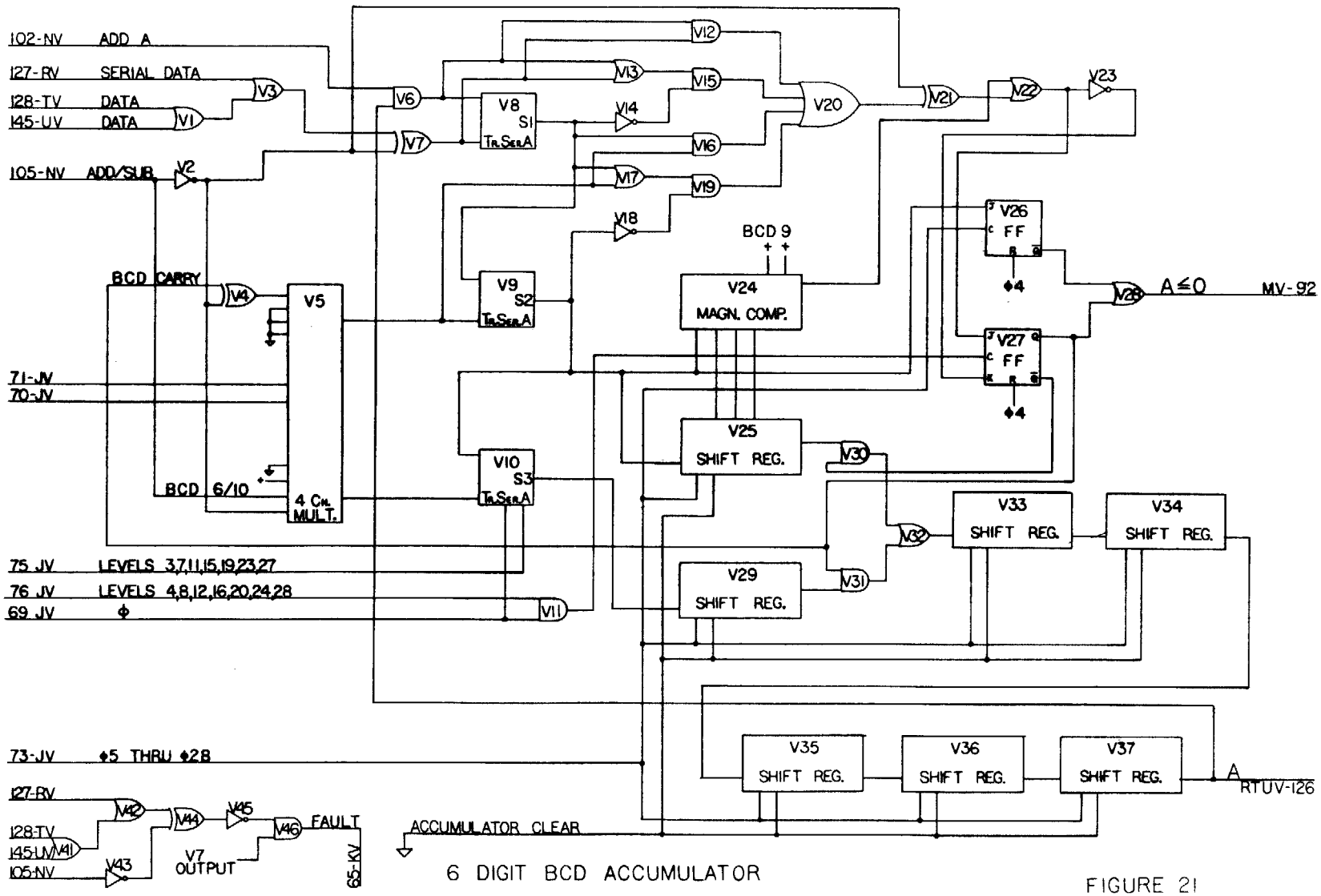
FIG. 21, sheet V, illustrates the 6 digit binary coded decimal accumulator.

FIG. 21 illustrates the six-digit binary coded decimal accumulator. Instructional levels coming in are, respectively, add accumulator from the control logic decoding of FIG. 16, serial data from the constants and storage of FIGS. 18, 19 and 20, the add or subtract instruction from the control logic decoding of FIG. 16, clocking time signals from the clock generator of FIG. 12, and four additional clocking signals from the clock page, FIG. 12, input into the logic circuitry of FIG. 21, as shown. The four top input lines feed through or gates V1 and V3 into and gate V6 and exclusive or V7 and further to a triple serial adder V8. The other three lines feed into an inverter V2, or gate V4, a dual four-bit multiplexer V5, the output of which feeds into the triple serial adders V9 and V10. The group of three lines from the clock in FIG. 12 feeds into and gate V11 and triple serial adder V10. Other logic circuitry takes the output of the three triple serial adders V8, V9 and V10, feed through the electrical connection as shown on FIG. 21 to inverter V14, and gate V15, and gate V16, or gate V17, inverter V18, and gate V19, or gate V20, exclusive or gate V21, and gate V22, inverter V23, magnitude comparitor V24, four-bit shift register V25, JK flip-flops V26 and V27, or gate V28, four-bit shift registers V29, and gates V30 and V31, or gate V32 and four-bit shift registers V33 through V37. There are two outputs for the six-digit binary coded decimal accumulator. The first output is from or gate V28 and feeds to the programmed arithmetic section of FIG. 15. This output signal is the logic signal metered back to the programmed arithmetic section indicating that the accumulator signal is less than or equal to zero. The output signal from V37 of the four-bit shift register provides an output of the number in the accumulator. Logic circuitry V41 through V46 detects an operational fault which may occur in the accumulator circuit. Logic components V41, V42, V43, V44 duplicate components V1, V3, V2, V7, respectively, so that both logic circuits receive the same inputs and the outputs of V44 and V7 should always be the same. V45 inverts V44 to make it an opposite to V7. Then V45 and V7, which should always be opposites, are fed into and gate V46. Any error will result in a high output from V46 and since it outputs line 65-KV to scanner K2, the fault will be detected.

NUMERIC DISPLAY

Figure 22:
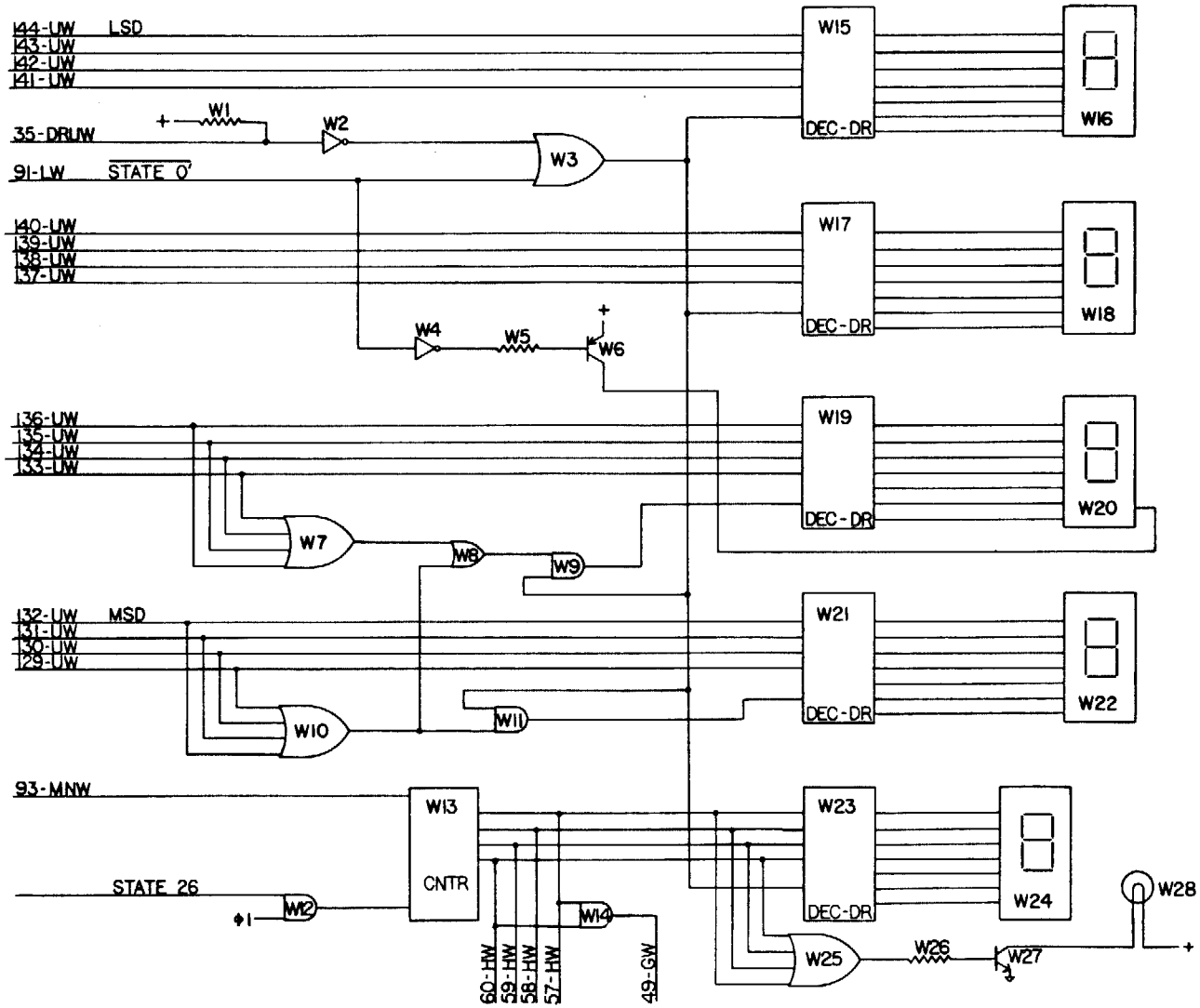
FIG. 22, sheet W, illustrates the numeric display.

FIG. 22 illustrates the numeric display. The fare display of W16, W18, W20 and W22 shown on FIG. 2 utilizes large seven-segment digits to indicate on the meter face the exact total fare the customer owes for a ride. Every charge being made is added to all other charges and displayed on this set of four digits. Zero blanking is performed on any insignificant leading zeros. The decimal is also blanked during display functions not using it. In addition to displaying taxi fares, this display is also used for displaying two other functions. In the tamper program, code numbers are detected tampers are displayed instead. This tamper number indicates exactly what tamper occurred. In the calibration operation, the digital display is used to display the exact sensor count, the number of drive shaft revolutions while the calibration data is being taken. There is also a seven-segment digit W24 for the extras display. It displays the number of extras that have been charged and added into the total fare which is being displayed on the four seven-segment digital displays on the fare display. Every extra added adds a count of one to the extras display. When a trip is over and the meter is turned off, this display is reset back to zero in preparation for the next trip. There is also an extras light W28 following the digit on the same horizontal plane. The four groups of four input lines 129UW through 140UW connect to the four-fit serial registers U45 and U46 of the constants and storage page of FIG. 20. These registers store the total fare. Resistor W1, inverter W2, or gate W3 enables the display to dispay any number that is input during the calibration. Inverter W4, resistor W5 and switching transistor W6 connect to the hundreds display to provide the decimal point. Or gates W7 and W10, or gate W8, and gate W9, and and gate W11 input to decoder drivers W19 and W21, to blank insignificant zeros of the hundreds and thousands displays digits W20 and W22. The master clear input and the state 26 input from the program arithmetic section of FIG. 15 feed into binary coded decimal counter W13 subsequently to decoder driver W23 and into the seven-segment extras display digit W24. Or gate W25, resistor W26 and switching transitor W27 actuate the extras display light W28 behind a panel labeled "extra" on the face on the taximeter of FIG. 2 to backlight the panel when extras are added.

RECORD COUNTER DRIVERS

Figure 23:
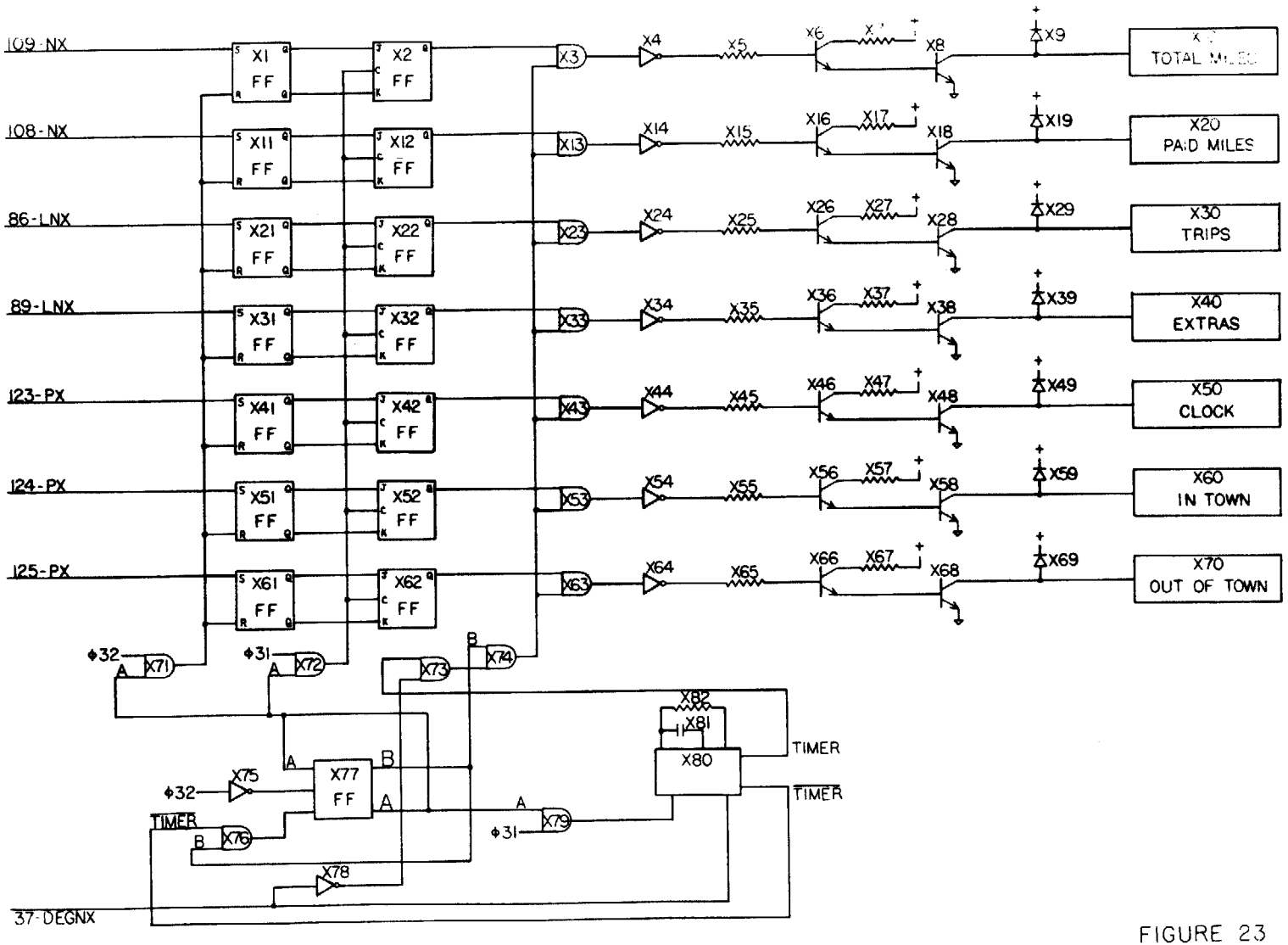
FIG. 23, sheet X, illustrates the drive electronic circuitry for the mechanical counters.

FIG. 23 illustrates the drive electronics for the mechanical counters. The first four lines representing the total miles, paid miles, trips, and extras are taken from logic decoding of FIG. 16. The bottom three lines, clock, in-town miles and out-of-town miles, are taken from the clock-running sequencer of FIG. 17. Each line has two JK flip-flops, an and gate, an inverter, a resistor, a switching transistor having a resistor on the collector, a second switching transistor, feeding to each respective electromagnetic counter. The circuitry provides a ground for the electromagnetic counter over a timed period to permit the counter to click once. The timing is provided by the circuitry of the lower portion of FIG. 23 showing and gates X71, X72, X73, X74, inverter X75, and gate X76, JK flip-flop X77, inverter 78, and gate X79 and a monostable stable multivibrator X80 whose timing period is determined by the RC combination of capacitor X81 and resistor X82. The timer provides a timing period long enough to hold the Q-line of JK flip-flops, respectively, X2, X12, X22, X32, X42, X52 and X62 high, along with and gates X3, X13, X23, X33, X43, X53 and X63, long enough to permit the electromagnetic counters to be grounded for one switching pulse.

Figure 24:
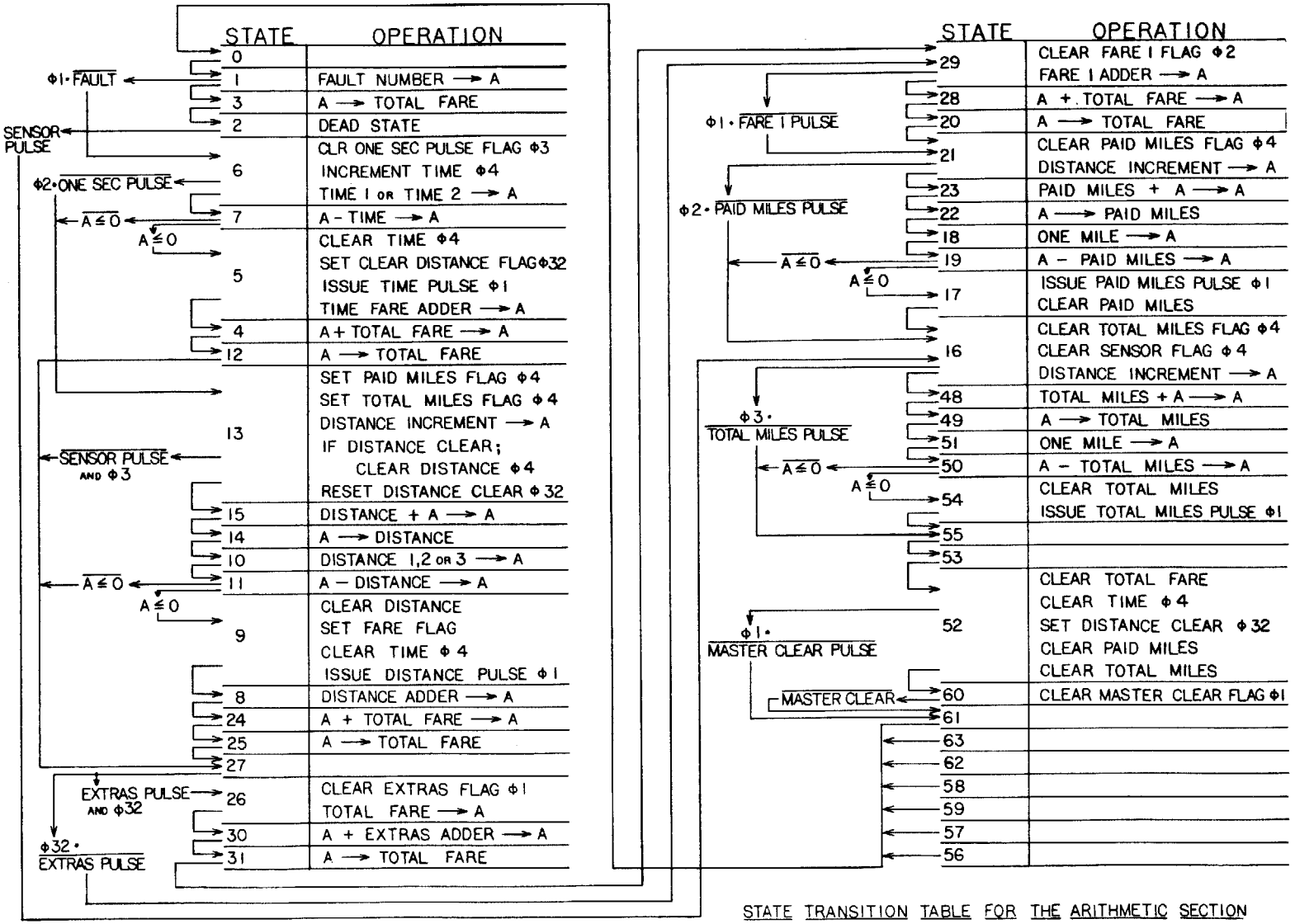
FIG. 24 illustrates the state transition table for the arithmetic section of FIG. 15.

FIG. 24 illustrates the state transition table for generation of the states of the arithmetic section of FIG. 15 and was described in detail with the accompanying description of FIG. 15 for setting forth the various transition states of the circuitry of the output of the figures, particularly relating to the four-to-sixteen decoders M64, M65 and M66 of FIG. 15. The table illustrates the outputs of the four-to-sixteen line decoders M64 through M66 over the timing circuitry of the 32-phase clock of FIG. 17.

PREFERRED MODE OF OPERATION

Manual Controls

The taximeter face panel of FIG. 2 has on it six manual pushbutton controls G1-G6 that make inputs into the taximeter to control its manual operation. These six controls are operable only under the specific program that is controlled by the taximeter system.

Sequence of Operation

All of the controls operate in a fixed sequence such that only control inputs which are operationally logical can be performed. This is accomplished by either enabling or disabling the controls according to the present state of the taximeter operations. Referring to FIG. 2, the following discussion is a typical sequence of operation of the manual controls G1-G6. With the taximeter in the "off" condition, state 1, the only two controls enabled are those for selecting rate G1 and starting the meter "flag thrown" G2. Depressing the select rate G1 control causes the meter to switch internally to the programmed charged rate from an out-of-town trip. Depressing select rate G1 again causes a switch back to the in-town rate. Each further depression of G1 continues this switch to the other of the two rates. This is done to allow the driver to select the correct rate to be charged for the trip. When he has selected thr proper rate, the driver will then depress the meter start control G2 to enable the meter rate charging system for the trip. This will cause the meter to "lock up" on the charge rate that was selected for the trip. Additionally, depressing the meter start G2 control causes the disabling of the rate select G1 and meter start G2 controls and now enables state 2, where the add extras G3 control and the stop clock G5 control are operable. The start clock G4 and stop member G6 controls remain disabled as before. Depressing the add extras G3 control once will cause the addition of one extras charge to the total fare being charged. Additional depression of the add extras G3 control will result in more extras charges being added. When the meter start G2 control was depressed, the clock was started for the time charging aspect of the taxi fare and this is the reason why the stop clock G5 control is presently enabled. When the stop clock G5 control is depressed the time charging will be suspended. Depression of the stop clock G5 control also causes the next sequential change in the operation of the controls. It causes the enabling of the state 3 condition, where the start clock G4 and stop meter G6 controls are operable. The add extras G3 and stop clock G5 controls become disabled, and the select rate G1 and start meter G2 controls continue as disabled. Depressing the start clock G4 control will restart the time charging in the meter and sequence the controls back to state 2. However, if the stop meter G6 control is depressed, the meter is turned off and the controls will sequence back to state 1 in readiness for the next trip.

The operation of the manual pushbutton controls is subject to four overriding factors. Whenever the vehicle attains a minimum speed of about five to ten miles per hour and the meter controls are in state 2, the add extras G3 function is disabled for the remainder of the trip. Also, when the controls are in state 3 and the vehicle reaches minimum speed, the clock for time charging is reactivated and the controls sequence to state 2. Additionally, whenever the vehicle attains or exceeds said minimum speed, all of the manual controls are disabled. This is done regardless of what state the controls may be in at the time. Its purpose is to disallow any accidental or mischievous operation of the controls while the taxi is moving. As soon as the vehicle speed becomes less than the minimum speed, the controls will again become operational in whatever state is appropriate at that time.

The last overriding factor is that in which a tamper has occurred in the taximeter system. The tamper program calls for the unconditional disabling of all of the manual controls on the meter. The controls become disabled and remain disabled until such time as the tamper has been remedied and the correct external reset code has been applied to effect a resumption of normal meter operations.

ILLUMINATED OPERATION OF MANUAL METER CONTROLS

The manual controls are of the illuminated pushbutton type. A control is provided for each of six manual functions. The controls are select rate, G1; start meter; G2; add extras, G3; start clock, G4; stop clock, G5; and stop member, G6.

The illumination of the switches follows the logical operational pattern of the control switches. When any given control switch is able to perform its functional input, that control button is illuminated. If a control button is not illuminated, that control will produce no action when depressed. An exception to this rule occurs with two controls. The select rate G1 and meter start G2 controls are not illuminated whenever the taxi ignition is turned off, although both controls are still functional. This is the vehicle parked, not in use, mode and burning of these bulbs is undesirable at that time.

RATE DISPLAY PANELS

In FIG. 2 are two schedule display panels, "in-town" and "out-of-town". The panels have listed on them the rate of charges under which taxi passengers will be charged for their ride. The out-of-town panel 131 gives the particulars for out-of-town trip charges. The in-town panel 132 gives the particulars for in-town trip charges. The panels list the constants charging program that has been programmed into the taximeter. The panels are illuminated from the rear in such a way that they are readable only when the backlighting is turned on. Through switch G1 the backlights are controlled in coordination with the taximeter system. With the taximeter off and no passengers in the taxi, the backlighting is left off. When a passenger is in the taxi, the seat switch under him sends a signal to the taximeter control system indicating his presence. If a passenger signal is present and the meter is off and there has not been a select for the out-of-town rate, both panels are lighted. With a passenger and the meter off and the out-of-town rate selected, the out-of-town rate panel 131 is lighted and the in-town rate panel 132 is not lighted. These panel lighting configurations indicate which charge rate will be engaged when the meter is turned on. If either both panels are lighted or both panels are dark, a meter start will cause the in-town rate charging system to be engaged. If the out-of-town panel 131 is lighted and the in-town panel 132 is dark, a meter start will engage the out-of-town rate charging system.

In any event, when the meter is started, the meter will be engaged in whichever rate of charge system was selected and the rate display panel that specifies that rate will be lighted. The panel for the rate not being used will not be lighted. In addition, since the meter start causes the rate to be locked in and unchangeable for the remainder of that trip, no change will occur in the panel lighting either. When the meter is turned off, the panels will return to operating in the previous pattern of both lighting when a passenger is in the taxi until a rate is selected through the "rate select" button or start meter is activated.

EXTRAS DISPLAY

The taximeter face panel of this invention has on it an extras display digit W24 and a backlighted panel W28 labeled "extra". Together they comprise an extras display. Its purpose is to display the exact number of extra passenger charges that have been added to the taxi fare for the taxi ride which is in progress. Prior meters displayed extras independent of the taxi fare on a separate three or four digit monetary display. This resulted in two separate money amounts being shown on the meter face which had to be added together to determine the total charge to the customer. The monetary amounts charged for the extra passengers count shown on the extras display W24, W28 have been automatically added to the other trip charges and are a part of the total fare being shown on the fare display W16, W18, W20, W22. This results in better accuracy with less effort and less confusion.

AUTOMATIC METER STARTS

The taximeter described herein is designed to determine when a customer is present in the taxi and then to automatically start the meter whenever the driver has not already started the meter. This automatic start prevents "highflagging" and its resultant revenue losses. Automatic meter starting is accomplished in the following manner.

In one method, seat switches, like B31 of FIG. 5, are used to detect the presence of a person in the taxi. Additionally, circuitry is provided in the meter that monitors incoming speed pulses, using them to determine when the taxi attains a selected minimum speed. These two are combined so that if a passenger is present in the taxi and the taxi is moving at or above the minimum speed, the meter is automatically started.

In the other method, seat switches, like B31 of FIG. 5, again detect passengers and circuitry calculates any distance traveled while a passenger is in the taxi. If a passenger is present and the taxi travels a certain distance, e.g., 400 feet or more, the logic circuitry will conclude that the passenger is in fact a taxi customer and the taximeter is automatically started on that basis.

AUTOMATIC EXTRAS CHARGING

A manual add extras G3 control on the taximeter provides for the addition of extras charges to the total fare being charged. All of the seat switches H1, H11, H13, H15, H21, H23, H25, H27 and H29 of FIG. 11 are fed into passenger counting circuitry which outputs signal logic "1" signals for each passenger in the taxi. Each of these signals is sequentially fed into a binary coded decimal counter H66 which totals the count.

However, since an extra is defined as any passenger in the taxi beyond the first passenger, circuitry has been added to inhibit the counter H66 from counting the first passenger signal. This results in the counter H66 showing the total extras count.

Any extras already charged are counted on binary coded decimal counter W13 of FIG. 22. This count and the extras count made on counter H66 are then compared. If the number of extras in the taxi is greater than the numbers of extras already added to the fare, signals are sent to the extras adding circuitry to cause adding of the extras that have not been charged.

It should be further noted that the automatic extras operation just described is initiated when the taxi attains minimum speed. Minimum speed is used to distinguish between someone just sitting in the taxi and an actual customer taking a taxi ride. Furthermore, other control circuitry provides for a disabling of the automatic extras circuitry as soon as it completes any given calculation and adds appropriately to the taxi fare. The circuitry is reenabled again each time the taxi stops, since this is the only period during which any change in the number of passengers can occur. This results in a recheck of the passenger and extras count the next time the taxi attains minimum speed and a further automatic extras add if it is appropriate. Additionally, every time a trip ends, the stop member G6 control causes the extras counter W13 of FIG. 22 to be zeroed. This prepares the automatic extras circuitry for accurately computing and adding the extras of the next trip.

RETROACTIVE DISTANCE CHARGING

During normal taxi operations, many drivers turn on their meters after they begin driving at the start of a trip; often, this allows the taxi to travel anywhere from a few feet to as much as 200 feet or more before the meter starts calculating fare charges. At times, factors such as heavy traffic or being in a hurry or being distracted or just plain forgetfulness cause a driver to forget to turn on his meter. All of these elapsed distances have, until now, been a cause of lost taxi revenue.

The taximeter system as described incorporates within it a new method of operation that automatically totals these previously lost distances and includes them in the fare being charged. The system operates in the following manner.

As long as the passenger remains seated in the taxi, the meter will calculate how far the taxi travels and subtract that distance from the first distance. Then, when the meter is started, manually or automatically, the meter system will use the result of the subtraction as the first distance to be used for fare charging. Thus, as the taxi travels on that trip, the first distance charge will occur precisely at that distance which is exactly the specified distance No. I (FIG. 18) away from where the customer entered the taxi.

In the event that some distance is traveled but no meter start is made, the calculated distance so far elasped will be discarded when the passenger gets off the seat and leaves the taxi. The distance is only calculated while a passenger is present and is used only if the meter is started. This protects the driver and his company from losing revenues to which they are entitled.

DISTANCE CALIBRATION

Calibration of the meter occurs in two stages. First is the determination of the distance increment numbers needed on decimal to binary switches U3, U5 and U6 of FIG. 20. Second is the programming of those numbers onto the switches.

The determination of the distance increment numbers is as follows. First, a calibration control unit 121 of FIG. 4 is plugged into a connector 134 on the meter. This completes the connection of lines 9-AD through 12-AD from the calibration unit to the internal meter circuitry. For convenience and added complexity for a would-be-tamperer, it is suggested that this calibration control 121 and the reset module 120 use the same connector 134 on the meter and be housed as one unit externally. Closing switches A11 and A12 engages the calibration circuitry in the meter and causes the following to occur. (1) The normal power line 1-AD supplying current to decimal to binary switches R12, R13, R15 and R16 is disconnected and grounded. This forces shift registers R14 and R17 to read four zeros. (2) The normal power line 9-AD to switches U33 and U34 is also changed from plus to ground, thus causing an all zero output to shift register U35. (3) The binary "1" line normally fed by swith U34 is artificially held high. (4) The fare display digits W16, W18, W20, and W22 are also enabled by line 35-DRUW which feeds the decoder drivers W15, W17, W19, W21 for them.

These operations cause the following. (1) R14 and R17, being at zero, cause an add fare pulse to be issued every time the taxi's driveshaft completes one full rotation. (2) and (3) cause a fare add of 1 to be made everytime an add fare pulse is issued. (4) causes the resultant calculations of (1), (2) and (3) to be shown on the fare display digits. The result of these operations is a count of every driveshaft rotation which is shown on the fare dislay W16, W18, W20 and W22.

To determine the distance increment number, which is set as the number of feet traveled by the taxi in one exact rotation of the driveshaft, one simply does the following. Bring the vehicle to the starting line of a precisely measured track. In this case we will use 5280 feet. Engage the calibration control unit 121. This will set up the counting of driveshaft rotations. Drive the taxi to the exact finish line of the 5280 foot course and stop. Read the number being displayed on the meter. It is the exact number of driveshaft rotations that occurred during the traversing of the 5280 foot course. Let us say it is 2000 being displayed.

Thus, it takes 2000 driveshaft rotations to travel 5280 feet. By dividing the distance, 5280 feet, by the number of driveshaft rotation, 2000, one gets the number of feet traveled during one rotation of the driveshaft. In this case 5280 feet $\div$ 2000 = 2.64 feet per rotation. This is the needed number to be placed on the distance increment switches, U3 U5 and U6. This number is entered on the switches which are placed within the meter box. To do this, one just slides the meter out (a tamper), enters the number on the switches, and then slides the meter back into place. Then, a reset of the meter is performed; this completes the calibration process. From this point on, the distance increment number will be used by the meter to convert driveshaft rotation pulses into the actual distance traveled by the taxi and that data is used, along with the other programmed constants, to perform accurate fare charging, etc. Removal of the calibration control 121 unit disengages the calibration circuitry automatically, thus putting the meter back on its original set of constants.

RATE CHANGES

Changing the fare rate variables of a taximeter has been a sore spot for taxi owners. They must purchase new gears or electronic components, often having to wait several weeks for their delivery, and hire expensive skilled labor to make the needed changes on a meter, which could take several hours per meter.

To taximeter of this invention provides a full set of decimal to binary conversion switches, see R3, R4, R5 and R6 of FIG. 18, which are used to make rate changes. Every rate change variable can be set on these switches in decimal form in only a few minutes. One only requires a knowledge of the numbers to be placed on each switch. This obviates any need for new parts or skilled labor to make a rate change. Additionally, the rate change can be made immediately when it is approved without any delays. A vital part of this rate change method is the taximeter tamper system. All of the switches are protected from unauthorized access through the use of several tamper detectors. Any attempt to make a rate change will cause the taximeter to be tampered and thus require a coded reset operation. The resulting advantages are clear; rate changes can be made easily and quickly at almost no cost under the full security of the taximeter tamper system.

TAMPER SYSTEM

One of the objects of this taximeter system is to prevent the theft of taxifares by drivers from their company. Crucial to this goal is the prevention of any type of tampering that would prevent the basic system from performing its functions properly. This tamper system is designed to prevent the occurrence of tampering by inhibiting drivers from attempting to tamper with the system. Because of its unique design, the system also lends itself readily to the task of detecting operational faults in the system itself.

The tamper and fault system breaks down into the following areas:

1. Fault and Tamper Detector devices, FIGS. 3, 5, 6, 7, 8, 9, 17, 18 and 21.
2. A Central Tamper Scanner, FIG. 13.
3. A Tamper Control Program, FIGS. 15 and 16.
4. Fault or Tamper Display on the taximeter face panel.
5. Tamper reset mechanism which includes, a. An external resetting device, FIG. 4.

b. An internal resetting control operation, FIG. 7.

In this taximeter system, there are four areas that must be monitored for tampering. They are the power supply, the speed sensor, the seat switches, and the taximeter control box.

THE POWER SUPPLY

The power supply line 13-BE coming into the taximeter has connected to it a chain of logic devices of FIG. 8 that terminate in an output which is either high or low. This output connects to the tamper scanner of FIG. 13. If power remains intact, the output stays low. But, if the lower is interrupted, and is then resumed, the output will go high, signaling that a power fault has occurred, and after a short time delay, goes low again. This causes the tamper to be detected, in spite of the fact that power has been restored.

SPEED SENSOR

The speed sensor 100 utilizes a switch to indicate whether or not the sensor case is opened or any of the wiring is tampered. The switch C9 is placed so that opening the sensor will cause it to make an output that will indicate a tamper. Current also runs past the switch through resistors C7 and C8 to an interface. The interface also detects high and low current levels constantly in addition to normal switch action. If any of the three conditions occur, they will send a high signal through an or gate and its high output will signal the tamper scanner. This setup is identical to the typical seat switch arrangement, except that the closing of the switch is indicative in as a tamper.

Vital to protecting the speed sensor unit and the speed pulse signals from tampering is the placement of the unit itself. It is to be connected to the transmission directly at the place provided for the speedometer cable. The speedometer cable is removed and the speed sensor device is then inserted so that the center shaft 107 in the speed sensor is turned directly by the gears on the driveshaft inside the transmission. Once in position, the sensor 100 solidly attaches by a bolt that screws into the original threaded hole, on the transmission, that was used to clamp the speedometer in place. This bolt has its head inside of the body of the speed sensor device. This makes access to it possible only by first gaining access to the interior of the sensor itself. The switch C-9 mentioned earlier is placed so as to detect any opening of the sensor case to gain access to its internal devices. The speedometer cable formerly inserted into the transmission is now inserted in the end of the sensor 100 on the side away from the transmission. It is then driven by the shaft inside of the sensor device thus providing for normal operation of the speedometer in the vehicle.

SEAT SWITCHES

Each seat switch is a totally separate circuit from each of the other seat switches, operating independently of the others so that any given switch cannot influence any other switch in any way. Current runs from the meter box out to each seat switch. If a switch is open, the circuit completes its path back to the meter through a resistor which causes a voltage drop on the line. When this circuit reaches the interface, the voltage of the line is at a specific level. If the switch is closed, the circuit path is routed through a different resistor which causes a different voltage drop on the line back to the interface.

The switch interface is set up to detect changes in the voltage on the return line coming into it from the seat switch. The interface is set up to detect three different voltage levels. If the voltage reaches a high level, it is detected by the uppermost interface which in turn makes an output indicating a fault. If voltage goes below a certain value, the lowermost circuit detects that and makes a fault output. Both of these outputs enter an or gate, the output of which is hooked to the fault scanner. The center circuit of the interface is set to detect the voltage level that results when the seat switch is closed and it then makes an output. That output indicates the presence of a passenger.

The voltage level of the line when the switch is open is at a point above the low level detector, below the high level detector and also below the switch closed voltage detector, causing no outputs.

METER HOUSING

Protection of the control circuitry within the meter box is also vital. The method used here is unique in its approach. The taximeter control box is to be conceived of as a drawer and slides into a meter housing box. All external interfaces to the taximeter are connected directly to the housing and then to a connector placed internally in the meter housing box. On the back of the taximeter control box is another connector. Its lines go internally in the taximeter control box to their appointed connecting points. Then, when the taximeter control box is pushed into the meter housing box, the two connectors are joined. This completes the circuits from the external interfaces all the way to the control circuits within the taximeter control box. Once pushed into place, the taximeter control box should be held in place with a mechanical lock that prevents sliding the taximeter control box out of the housing. This will prevent any accidental unmating of the connectors between the two units. It should be noted that any disconnection of this sort would result in a multiplicity of tampers to the system.

METER FACE PANEL

Only the face of the taximeter control box is exposed. The devices within the meter box are to be protected as follows. The face 130 itself is made of plexiglass or a similar material. The rate display panels 131-132, the digital display W16, W18, W20, W22, the extras display W24 and 133 and the recording counters X10, X20, X30, X40, X50, X60 and X70 are all placed behind the plexiglass panel 130 and cannot be reached unless the plexiglass panel is first removed or access holes are made in it. The manual control switches G1-G6 are mounted from the inside of the meter box and cannot be removed from the front of the panel. Physical destruction of the panel is easily observed from the front, and serves no advantage because the devices thus exposed do not lend themselves to tampering. The numbers on the recording counters may be changed, but the counters are of a non-reversible type and operate only in one direction, that of increasing the number. Having four digits, this involves physically incrementing a counter a full cycle, almost 10,000 counts to reach the desired new number sequence. Faster forward counting is possible by electrical operation of the counter; but, the counter terminals sit back about 3 inches from the face panel and are shielded by a baffle to prevent probing. This necessitates the removal of the panel itself in order to gain access to them. Removing the panel is detected electronically in the following manner. A switch E51 is mounted against the back side of the panel so that it will be activated if the panel is removed. The signal from that switch is connected to the tamper scanner. The switch is also placed such that its operation cannot be stopped until the panel is fully removed.

RESET-CALIBRATE CONNECTOR

One other device on the face panel which needs protection is the connector, 134 of FIG. 2, that mates with the external reset module 120 and calibration control 121. Protection of the connector is achieved in the following manner. A cover plate is constructed in such a way that when it is placed over the connector it closes a switch, D30 of FIG. 7, in the connector. If the cover plate is removed, the switch D30 is opened. Switch D30 is used to activate a short timing circuit which, at maturity, outputs a tamper signal. The timing circuit control is provided with a timer stop mechanism which only functions after a reset code input, from 120, and before the taxi reaches minimum speed. In this condition, the timer is stopped by closing switch D30. The timer stop, however, is disabled the first time the taxi reaches minimum speed. Thus, any opening of switch D30 thereafter will result in an unstoppable time delay tamper. The timer stop can thus be used by the taxi company to, in effect, "load" the cover plate to detect a tamper. A fuller discussion of this circuitry is in the description of FIG. 7. Additionally, mentioned earlier was a mechanical lock to be used to prevent the taximeter control box from accidential removal from its housing box; this lock can also be placed in such a way that it also prevents any accidental dislodging of the reset connector cover plate. Also contemplated is the use of a lock on the cover plate alone. In any event, the cover plate should be protected in some way against accidental dislodging, as that would result in a tamper. Protection beyond the areas discussed is possible, but probably is not worthwhile. The other external devices serve meter functions but are not vital to the main operational program. Disconnecting these other devices will not prevent the automatic operation of the meter.

TAMPER OPERATION

Whenever a tamper occurs, this taximeter system performs the unique operation of disabling itself from normal fare charging operations. Instead, it causes the external toplight B11 and B12 of the taxi to indicate the presence of the tamper. By use of a tamper scanner, FIG. 13, the specific tamper is detected and a preassigned tamper number for that tamper is caused to be shown on the fare display, FIG. 22, of the meter face panel. As examples, the present invention assigns tamper numbers as follows; 8800 is a power tamper, 8801 is a reset code mismatch, 8802 is a seat switch tamper, 8809 is a speed sensor tamper, etc. Others are shown as inputs to K1 and K2 of FIG. 13. Thus, a tamper in a specific area will result in the display of a specific tamper number on the fare display of FIG. 22. This tamper number can only be removed through the application of a specific reset code from device 120 which is held by the taxi company. Any driver that tampers with the taximeter will be forced to return to his company in the tampered condition and be subject to reprimand or dismissal by his company.

CONTINUOUS TAXIMETER SYSTEM OPERATION

One aspect of the taximeter deserves some special consideration. This taximeter system provides for constant continuous operation. The taximeter uses circuitry which requires negligible current to sustain operations; this makes possible continuous system operation, even when the taxi is parked and not in use. While the taximeter appears to be "off", it is far from it. The tamper scanner and tamper detectors are always looking for a tamper. The seat switches are ready to detect a passenger and the speed sensor will send distance pulses if the taxi moves. In short, the full taximeter system is operating at full speed ready to instantaneously perform any operation in its program.

TYPICAL IN-TOWN TRIP

The most frequent taxi rides involve a customer going somewhere in the city in which he lives; this is commonly called an "in-town trip".

Initially, one finds the driver parked by the curb waiting for a customer. The meter is completely dark at this time and appears to be dead; however, internally, the meter is powered and monitoring for any system fault or tampering that might occur and it is constantly waiting for an input signal requiring it to operate.

Now, a passenger comes along and enters the taxi. When he sits on the seat, sensing circuitry sends a signal to the meter indicating his presence. The meter now lights the two rate display panels to show the customer how he will be charged for his ride, whether it be in-town or out-of-town. At this point, then, he tells the driver where he wants to go, for example, to his home on the south side. The retroactive distance charge is also energized.

When the driver starts the taxi, a line 17-BE from the ignition to the meter sends +12 voltage current to the lights inside of the rate select G1 and meter start G2 control buttons. When these light up, one sees that those two switches are functioning.

These switches are functional all the time; but, with the ignition off, the lights are not provided any current to indicate such.

Assuming an "in-town" trip is intended, the driver does not make a rate select. The rate select G1 is used to choose the out-of-town rate charge system; not having this selected, the meter automatically switches into the in-town rate.

The driver now pushes the meter start G2 control. This causes the meter to count the trip on the trip counter, display the flag throw amount on the fare display, W16, W18, W20, W22, start the clock, engage the in-town distance charging system, darken the out-of-town rate display 131 panel, leave lit the in-town rate display panel 132 (it is the rate in use), disable the rate select G1 and meter start G2 control button and its indicator light, and enable the stop clock G5 control button and its indicator light.

Had the driver not started the meter; but, started driving instead, the following would occur. The retroactive distance charging system would begin calculating any distance traveled. Then, if the taxi reached a minimum speed, e.g., 10 miles per hour, the meter would be automatically started, since both minimum speed and passenger occupancy were sensed. However, if the speed remained under 10 miles per hour, the distance calculation would continue and upon the elapsing of a specified minimum distance, e.g., 1/10 mile or 528 feet, the meter would again be started automatically since both minimum distance and passenger occupancy were sensed. In either event, when the meter is started, the elapsed distance calculated by the retroactive distance charging system would at that point be used in the calculation of distance charges. This charge would thus be made back to when the taxi first moved with the passenger.

In any case, when the taxi reaches minimum speed, the manual control switches become disabled until the taxi slows to below the minimum speed, where they are reenabled. Manual extras, G3, if used, are also disabled for the remainder of the trip the first time the car reaches minimum speed.

Assuming as an example that the taxi has to wait for a train. When the taxi stops, the meter remains on and the clock continues calculating time charges and will add, e.g., 10 cents a minute. If the driver desires, at this point he can push the stop clock G5 control and suspend the time calculations and charging. Stopping the clock enables the start clock G4 and stop meter G6 functions; the driver now can push the start clock G4 again after the train passes. If the driver forgets, as soon as the taxi attains minimum speed again the clock will be restarted automatically.

At the destination, the driver will stop in front of his customer's home. He will then push the stop clock again to cease the fare charging of his customer. Mileage charges are stopped already since the taxi is not moving. The total fare is now held on the fare display indefinitely so that the customer can see what his bill is and how he was charged. The in-town rate display 132 panel is still on, having been locked in when the meter started. When the customer has paid the fare, the driver will push the stop meter control G6 to erase the fare display W16, W18, W20, and W22 to recycle the meter back to its state prior to the meter start. All that remains on now are the rate display panels, they will go out when the customer leaves. The rate select G1 and meter start G2 lights will go out if the ignition is turned off or the car reaches minimum speed. A full record of the transaction will also have been recorded on the electromagnetic counters X10, X20, X30, X40, X50, X60 and X70.

Various modifications are contemplated and may obviously be resorted to by those skilled in the art without departing from the apparent scope of the invention as hereinafter defined by the appended claims and only a preferred embodiment thereof has been disclosed. Rapidly changing technology devices such as microprocessors or new versions of integrated circuit chips readily lend themselves to incorporation or substitution into the circuitry of this invention. It would be considered well within the skill of the art and a matter of choice and design to implement changes in the disclosed circuitry, but such changes are only considered as obvious modifications within the scope of this disclosure to implement the disclosed operations of the taximeter.

Further, the taximeter may include more than the two disclosed charge rates. By appropriate additional circuitry, any number of different charging rates may be programmed into the meter logic.

Having thus described the invention, there is claimed as new and desired to be secured by Letters Patent:

1. In a taximeter for use in a taxi
   a. occupancy-sensing means to detect a passenger,
   b. speed-sensing means to measure speed of a taxi and including clock means and distance-sensing means sensing distances traveled by the taxi,
   c. logic means responsive to the occupancy-sensing means and to at least one of the speed-sensing means and distance-sensing means for starting the meter when
      1. a passenger is detected by the occupancy-sensing means, and
      2. said at least one means concurrently senses that the taxi has reached a predetermined speed or has traveled a predetermined distance, respectively.

2. The taximeter of claim 1 including tamper detecting means for detecting tampering with the meter and for producing a signal particularly indicating same.

3. The taximeter of claim 2 including display means, and means responsive to the tamper detecting means for displaying the particular tamper on the display means.

4. The taximeter of claim 3 wherein the display means includes the top light on the taxi.

5. The taximeter of claim 2 including means at least partially disabling the meter in response to said signals indicating tampering.

6. The taximeter of claim 5 including coded reset means within the meter and external coded reset means to reset the meter after at least partial disabling thereof.

7. The taximeter of claim 2 including fare display means for displaying a fare and means for suppressing the display of the fare in response to the signal indicative of said tampering.

8. The taximeter of claim 2 wherein the meter includes a meter housing and wherein the distance-sensing means includes motion-sensing means external of the housing for sensing motion of a taxi, the meter including tamper detecting means for detecting tampering with the occupancy-sensing means, motion-sensing means, power means and meter housing and for producing signals particularly indicating such tampering, display means, and means responsive to such signals for identifying and displaying a particular detected tamper on the display means.

9. The taximeter of claim 1 including a meter housing and wherein the distance-sensing means includes a motion-sensing means external of the housing for sensing movement of the taxi, and tamper detecting means including means for detecting tampering with the motion-sensing means and for producing a signal particularly indicating same.

10. The taximeter of claim 1 including tamper detecting means comprising means for detecting tampering with the occupancy-sensing means and for producing a signal particularly indicating same.

11. The taximeter of claim 1 including power means providing electric power to the meter and including tamper detecting means including means for detecting tampering with the power means and for producing a signal particularly indicating same.

12. The taximeter of claim 1 including fare calculating means responsive to the distance-sensing means for computing a fare, and means retroactively incorporating distance traveled prior to starting the meter into fare calculations based upon distance traveled.

13. The taximeter of claim 1 including fare-calculating means responsive to the distance-sensing means for computing a fare and a manual input switch for selecting a rate to which the fare-calculating means is responsive and further including means for disabling the switch during at least part of the time the fare-calculating means is operating.

14. The taximeter of claim 1 including fault detection means for detecting faults in electronic circuits of the meter and for providing signals indicative of particular faults, and display means for displaying indicia of a detected particular fault.

15. The taximeter of claim 1 wherein the distance-sensing means includes means for counting revolutions of a taxi drive shaft, and wherein the meter includes means to display counted revolutions.

16. The taximeter of claim 1 including fare calculating means responsive to the clock means and distance-sensing means for calculating a fare based upon time and distance, the occupancy-sensing means including means for counting the number of passengers in a taxi, and means responsive to the passenger counting means for adjusting fare calculation.

17. The taximeter of claim 1 including fare calculating means, manual input switches for selecting constants to which said fare calculating means is responsive, and means disabling said manual input switches in response to sensing by the speed-sensing means of a speed greater than a predetermined minimum speed.

18. In a taximeter for use in a taxi: occupancy-sensing means sensing passenger occupancy, speed-sensing means for measuring speed of a taxi, distance-sensing means for sensing distances traveled by the taxi, and logic means responsive to the occupancy-sensing, speed-sensing and distance-sensing means for starting the meter in response to:

a. detection of passenger occupancy, and
b. concurrent sensing by the speed or distance-sensing means that the taxi has reached a predetermined speed or had traveled a predetermined distance, respectively.

19. In a taximeter for use in a taxi: including a meter housing and a plurality of external sensing means for sensing different fare-computing parameters to which the meter is responsive, the meter including tamper-detecting means including means detecting tampering with either of at least two of said external sensing means and for providing signals particularly indicating which tamper was detected, and means for displaying indicia of the particular tamper detected.

20. The taximeter of claim 19 wherein the taxi includes a taxi toplight, and means responsive to the tamper detection means for indicating any tampers on the toplight.

21. The meter of claim 19 including fare calculating means for calculating a fare, manual input switches to which said fare calculating means is responsive, and further including means responsive to the tamper detection means for disabling said switches upon detection of a tamper.

22. In a taximeter having a meter housing and fare-collecting means, fare display means and means responsive to the fare collecting means for displaying the fare on the fare display means: tamper detection means detecting tampering with the meter, and means responsive to detection of a tamper for suppressing display of a fare on the fare display means, and a plurality of sensing means external of the housing to which the meter is responsive, wherein the tamper detection means includes means detecting tampering with the external sensing means and providing signals indicative of the individual tamper detected, and means for displaying on the fare-display means indicia of the particular tamper detected.

23. The taximeter of claim 22 including a meter housing and plurality of sensing means external of the housing to which the meter is responsive and wherein the tamper detection means includes means detecting tampering with the external sensing means and providing signals indicative of the individual tamper detected, and means for displaying on the fare display means indicia of the particular tamper detected.

24. A taximeter including a meter housing, external occupancy-sensing means to detect a passenger, external movement-sensing means to sense movement of a taxi, external power means to provide electric power to the meter, and tamper detection means for particularly detecting tampering with the individual movement-sensing means, occupancy-sensing means, power means and meter housing and for producing particular and distinctive signals respectively indicating such detected tampering, and means for displaying indicia of the particular tamper detected.

25. In a taximeter having means sensing the speed of the taxi, fare-calculating means, manual input switches to which the fare-calculating means is responsive, and clock means to which the fare-calculating means is responsive and wherein said manual input switches include a switch stopping said clock means, and means for restarting the clock means in response to sensing of a speed equaling or exceeding a predetermined minimum speed during fare calculation.

26. The taximeter of claim 25 and further including means for disabling the manual input switches in response to a sensed speed equaling or exceeding a predetermined speed.

27. The taximeter of claim 26 including means reenabling the manual input switches when the sensed speed has decreased below the predetermined speed.

28. In a taximeter including a meter housing, means sensing distance traveled and time elapsed and farecalculating means responsive to said sensing means to compute a fare:

constants furnishing means within the housing for providing constants fixing independent variables for the fare-calculating means, manually settable control means within the housing enabling the constants furnished to be manually changed, tamper detecting means including means for detecting tampering with said housing and said sensing means and for providing signals particularly indicative thereof, and display means for displaying indicia of the particular tamper detected.

29. The meter of claim 28 wherein the manually settable control means includes manually operable decimal to binary switches.

30. The taximeter of claim 28 including external, manual input switches for selecting particular predetermined constants from the constants furnishing means to enable selection of predetermined fare charging rates by a taxi driver.

31. In a taximeter having distance-sensing means and clock means and a meter housing including farecalculating means for calculating a fare based upon pre-determined constants and upon distance sensed by the distance-sensing means and time measured by the clock means or both:

constants furnishing means within the housing for furnishing said predetermined constants;

manually operated constants setting means within the housing for changing said constants;

tamper detecting means for detecting tampering with the housing and said distance-sensing means and for producing signals particularly indicative thereof, and display means for displaying indicia of the particular tamper detected.

32. The taximeter of claim 31 wherein the distances-ensing means including means sensing and counting rotations of a taxi drive shaft, and wherein at least one of said manually settable constants furnished relates drive shaft revolutions to distance traveled.

33. In an electronic taximeter having a meter housing and fare calculating means within the meter housing; a connector accessible from outside the housing, a cover plate preventing free access to the connector, tamper detecting means including means for detecting tampering with the cover plate and for producing a signal particularly indicating same, disablement means responsive to said signal for at least partially disabling the taximeter upon detection of a tamper with the cover plate, an external reset module operably connectable to said connector for allowing re-enablement of the taximeter, and reset means within the meter housing and operably connected to said connector for re-enabling the meter when said external reset module is operably connected to said connector.

34. The taximeter of claim 33 including display means and means responsive to the tamper detection signal for displaying indicia of the particular tamper on the display means.

35. In a taximeter:

a. distance-sensing means measuring distance traveled by a taxi, b. means for starting the meter, c. fare-calculating means responsive to the distance-sensing means for computing a fare, and d. means retroactively incorporating any distance traveled prior to starting of the meter into fare calculations based on distance traveled.

36. The taximeter of claim 35 and further including occupancy-sensing means to detect a passenger, said means for starting the meter being responsive thereto.

37. An easily calibrated taximeter comprising:

external means for sensing drive shaft revolutions and for producing signal pulses in response thereto;

internal means for counting said signal pulses;

display means operably connected to said internal means for displaying the count of said signal pulses;

manually settable constants furnishing means for providing a constant relating counted signal pulses to distance traveled;

fare-calculating means responsive to said constant for computing a fare based upon distance traveled;

an external unit that is operably connectable to said display means through an interface for selectively displaying the count of said signal pulses; and tamper detecting means for detecting tampering with said external means, said internal means and said interface and for producing a particular signal indicating same, said display means being responsive to said tamper detecting means so as to display particular indicia of said particular tampering.

38. In a taximeter having a housing and also having tamper detecting means for detecting tampering with the taximeter and disablement means for at least partially disabling the taximeter upon detection of a tamper:

external reset module means external said housing for providing an external reset code;

reset code comparison means operatively cooperable with said external reset module means for reading said external reset code and for comparing said external reset code with a predetermined reset code; and means responsive to said reset code comparison means for re-enabling the taximeter when said external reset code matches said rest code.

39. The taximeter of claim 38 and further including tamper detecting means comprising means for detecting tampering with said externally accessible connector and for producing a signal particularly indicating same after a predetermined delay.

* * * * *